US011626689B2

(12) United States Patent
Faith

(10) Patent No.: US 11,626,689 B2
(45) Date of Patent: Apr. 11, 2023

(54) ELECTRICAL CONNECTOR HAVING LATCH

(71) Applicant: Samtec, Inc., New Albany, IN (US)

(72) Inventor: Chadrick Paul Faith, Corydon, IN (US)

(73) Assignee: SAMTEC, INC., New Albany, IN (US)

( * ) Notice: Subject to any disclaimer, the term of this patent is extended or adjusted under 35 U.S.C. 154(b) by 0 days.

(21) Appl. No.: 17/695,901

(22) Filed: Mar. 16, 2022

(65) Prior Publication Data

US 2022/0209460 A1 Jun. 30, 2022

Related U.S. Application Data

(63) Continuation of application No. 16/632,720, filed as application No. PCT/US2018/043025 on Jul. 20, 2018, now Pat. No. 11,289,850.

(60) Provisional application No. 62/622,370, filed on Jan. 26, 2018, provisional application No. 62/535,729, filed on Jul. 21, 2017.

(51) Int. Cl.

| | |
|---|---|
| ***H01R 13/627*** | (2006.01) |
| ***H01R 12/72*** | (2011.01) |
| ***H01R 13/506*** | (2006.01) |

(52) U.S. Cl.

CPC ..... *H01R 13/6272* (2013.01); *H01R 12/724* (2013.01); *H01R 13/506* (2013.01)

(58) Field of Classification Search

CPC ..... H01R 13/506; H01R 13/6271; H01R 13/6272; H01R 13/6275; H01R 13/6273; H01R 12/724

USPC ..... 439/352, 353, 355, 357

See application file for complete search history.

(56) References Cited

U.S. PATENT DOCUMENTS

| | | | |
|---|---|---|---|
| 3,329,926 | A | 7/1967 | Akin et al. |
| 4,158,745 | A | 6/1979 | Keller |
| 4,621,885 | A | 11/1986 | Szczesny et al. |
| D315,331 | S | 3/1991 | Yamamoto |
| D316,704 | S | 5/1991 | Eto et al. |
| D316,846 | S | 5/1991 | Moriai et al. |
| D323,646 | S | 2/1992 | Suzuki et al. |
| D327,469 | S | 6/1992 | Moriai et al. |
| D328,590 | S | 8/1992 | Tanaka |

(Continued)

FOREIGN PATENT DOCUMENTS

| | | | |
|---|---|---|---|
| CN | 1467884 | A | 1/2004 |
| CN | 2749117 | Y | 12/2005 |

(Continued)

OTHER PUBLICATIONS

"Cable Assemblies/BiPass I/O/High-Speed Solutions", Molex, LLC., ©2018, 3 pages.

(Continued)

*Primary Examiner* — Marcus E Harcum

(74) *Attorney, Agent, or Firm* — BakerHostetler

(57) ABSTRACT

A first electrical connector includes a first latch that is configured to releasably engage a second latch of a second electrical connector when the first and second electrical connectors are mated to each other. The first latch can include an attachment portion that attaches to the connector housing of the first electrical connector, and an engagement portion that is movable with respect to the attachment portion between an engaged position and a disengaged position.

29 Claims, 8 Drawing Sheets

(56) References Cited

U.S. PATENT DOCUMENTS 5,340,329 A 8/1994 Hirai
5,486,117 A * 1/1996 Chang ..... H01R 12/727 439/353
5,713,752 A * 2/1998 Leong ..... H01R 13/6275 439/923
5,741,150 A * 4/1998 Stinson ..... H01R 13/6275 439/157
5,919,063 A 7/1999 Wang
5,951,340 A 9/1999 Mueller et al.
D419,135 S 1/2000 Wu et al.
6,146,205 A 11/2000 Lai
D435,245 S 12/2000 Hwang
D435,831 S 1/2001 Ko
6,176,716 B1 1/2001 Mercurio et al.
6,217,365 B1 * 4/2001 Shinozaki ..... H01R 13/6272 439/484
D449,276 S 10/2001 Hwang et al.
6,409,543 B1 6/2002 Astbury et al.
D459,702 S 7/2002 Watanabe
6,462,957 B1 10/2002 Kwong et al.
6,491,529 B2 12/2002 Gray et al.
6,565,383 B1 5/2003 Wu
6,652,318 B1 11/2003 Winings et al.
D483,329 S 12/2003 Kuo
6,655,979 B1 12/2003 Lee
D485,532 S 1/2004 Lai
D490,377 S 5/2004 Sato
6,736,663 B2 5/2004 Lee et al.
6,799,986 B2 * 10/2004 Igarashi ..... H01R 13/6275 439/358
6,848,932 B2 2/2005 Bowling et al.
6,860,750 B1 3/2005 Wu
6,890,205 B1 5/2005 Wu
6,945,796 B2 9/2005 Bassler et al.
6,951,474 B1 10/2005 Wu
6,991,487 B2 * 1/2006 Wu ..... H01R 13/6275 439/358
7,083,459 B1 8/2006 Wu et al.
D539,746 S 4/2007 Lee
7,226,307 B1 6/2007 Chen et al.
D550,617 S 9/2007 Wang
D562,246 S 2/2008 Matsuzaki et al.
D576,954 S 9/2008 Hsiao
7,422,494 B2 9/2008 Fry et al.
7,473,124 B1 * 1/2009 Briant ..... H01R 13/629 439/352
7,581,978 B1 9/2009 Briant
D601,506 S 10/2009 Fukazawa et al.
D605,602 S 12/2009 Mase
D606,941 S 12/2009 Iijima
7,628,636 B2 * 12/2009 Yu ..... H01R 13/6275 439/372
7,666,023 B2 * 2/2010 Wu ..... H01R 13/6275 439/352
7,686,622 B2 3/2010 Dawiedczyk et al.
7,794,262 B2 9/2010 Briant et al.
7,837,522 B1 11/2010 Hoover et al.
7,841,889 B2 11/2010 Gerard et al.
D631,016 S 1/2011 Iijima et al.
D640,638 S 6/2011 Ngo
D649,518 S 11/2011 Zhu
D650,754 S 12/2011 Bodmann et al.
8,075,332 B2 * 12/2011 Amidon ..... H01R 13/6275 439/352
8,231,400 B2 * 7/2012 Phillips ..... G02B 6/4201 439/357
8,282,430 B2 10/2012 He et al.
8,348,701 B1 1/2013 Lan et al.
8,398,429 B2 3/2013 Costello
8,475,197 B2 * 7/2013 Zerebilov ..... H01R 13/6275 439/352
8,506,323 B2 8/2013 Costello
8,545,254 B2 * 10/2013 Amidon ..... H01R 13/639 439/352
8,591,248 B2 11/2013 Pepe et al.
D699,683 S 2/2014 Yoshisuji
D706,724 S 6/2014 Mccartin et al.
D708,580 S 7/2014 Mccartin et al.
8,888,529 B2 11/2014 Buck et al.
8,888,530 B2 11/2014 Trout et al.
8,998,645 B2 4/2015 Vanaleck et al.
D729,745 S 5/2015 Vanderwoud
9,052,473 B2 * 6/2015 Schmelz ..... H01R 13/629
D745,852 S 12/2015 Harper et al.
9,209,545 B2 12/2015 Hemmi et al.
D748,589 S 2/2016 Endo et al.
9,257,778 B2 2/2016 Buck et al.
9,293,852 B2 3/2016 Glick et al.
9,356,373 B2 5/2016 Komoto et al.
D768,089 S 10/2016 Liu
D772,168 S 11/2016 Harper et al.
9,608,348 B2 3/2017 Wanha
D801,283 S 10/2017 Walsh et al.
D816,044 S 4/2018 Zerebilov et al.
9,985,367 B2 5/2018 Wahna et al.
D823,814 S 7/2018 Buck et al.
10,020,614 B1 7/2018 Bucher
D826,863 S 8/2018 Schafmeister
D835,046 S 12/2018 Bingham
10,199,768 B2 2/2019 Nagasaki
10,230,196 B2 3/2019 Phillips et al.
10,439,330 B2 10/2019 Mongold et al.
10,534,145 B2 1/2020 Zbinden et al.
10,574,002 B1 2/2020 Henry et al.
D877,084 S 3/2020 Buck et al.
D877,700 S 3/2020 Buck et al.
D879,724 S 3/2020 Buck et al.
D881,133 S 4/2020 Buck et al.
D896,183 S 9/2020 Musser et al.
D924,169 S 7/2021 Buck et al.
D941,779 S 1/2022 Buck et al.
D941,780 S 1/2022 Buck et al.
2003/0143886 A1 7/2003 Nemoto
2003/0194889 A1 10/2003 Golat et al.
2003/0228788 A1 12/2003 Igarashi et al.
2004/0115983 A1 6/2004 Liang
2004/0121633 A1 6/2004 David et al.
2004/0248446 A1 12/2004 Kuroki
2005/0101176 A1 5/2005 Kachlic
2005/0148219 A1 7/2005 Myer et al.
2006/0094281 A1 * 5/2006 Dang ..... H01R 13/6275 439/352
2007/0155255 A1 7/2007 Galauner et al.
2007/0281543 A1 12/2007 Boegelein et al.
2008/0102702 A1 5/2008 Sercu et al.
2008/0166090 A1 7/2008 Kiani et al.
2008/0305690 A1 12/2008 Zhang et al.
2009/0201658 A1 8/2009 Lemke et al.
2009/0215309 A1 8/2009 Mongold et al.
2009/0233492 A1 9/2009 Mizukami et al.
2009/0291584 A1 11/2009 Wu
2010/0178779 A1 7/2010 Davis et al.
2010/0203765 A1 8/2010 Goossens et al.
2010/0240233 A1 9/2010 Johnescu et al.
2010/0255731 A1 10/2010 Oyake et al.
2011/0009011 A1 1/2011 Johnescu et al.
2011/0294357 A1 12/2011 Tanaka
2011/0300736 A1 12/2011 Katagiri et al.
2012/0058665 A1 3/2012 Zerebilov et al.
2012/0329305 A1 12/2012 Ritter et al.
2013/0004120 A1 * 1/2013 Zbinden ..... G02B 6/4293 385/14
2013/0023157 A1 1/2013 Omer
2013/0115815 A1 5/2013 Lim et al.
2013/0273781 A1 10/2013 Buck et al.
2014/0038447 A1 2/2014 Brown et al.
2014/0065899 A1 3/2014 Aboulkassem et al.
2014/0213125 A1 7/2014 Hemmi et al.
2014/0220795 A1 8/2014 Bai et al.
2014/0242817 A1 8/2014 Mongold et al.
2014/0273670 A1 9/2014 Crutcher
2014/0295680 A1 10/2014 Yuqiang et al.
2014/0335707 A1 11/2014 Johnescu et al.

(56) References Cited

U.S. PATENT DOCUMENTS

| | | | | |
|---|---|---|---|---|
| 2015/0079845 | A1 | 3/2015 | Wanha et al. | |
| 2015/0255895 | A1 | 9/2015 | Knowlden et al. | |
| 2016/0006150 | A1 | 1/2016 | Bachmutsky | |
| 2016/0109668 | A1 | 4/2016 | Pfnuer et al. | |
| 2016/0111824 | A1 | 4/2016 | Phillips | |
| 2016/0149341 | A1* | 5/2016 | Reed | H01R 13/629 439/352 |
| 2016/0149730 | A1 | 5/2016 | Navid | |
| 2016/0164196 | A1 | 6/2016 | Wu et al. | |
| 2016/0233598 | A1 | 8/2016 | Wittig | |
| 2016/0261060 | A1 | 9/2016 | Sechrist | |
| 2017/0077621 | A1 | 3/2017 | Liao | |
| 2017/0170604 | A1 | 6/2017 | Endo et al. | |
| 2017/0187158 | A1 | 6/2017 | Crowe | |
| 2017/0229792 | A1 | 8/2017 | Wu et al. | |
| 2017/0310029 | A1* | 10/2017 | Lee | H01R 13/6583 |
| 2017/0357060 | A1* | 12/2017 | Jones | H01R 13/6275 |
| 2018/0054012 | A1 | 2/2018 | Zhu et al. | |
| 2018/0076581 | A1 | 3/2018 | Tsai et al. | |
| 2018/0131144 | A1 | 5/2018 | Xing et al. | |
| 2018/0294592 | A1 | 10/2018 | Huang et al. | |
| 2019/0013619 | A1 | 1/2019 | Obata et al. | |
| 2019/0044287 | A1 | 2/2019 | Lin et al. | |
| 2019/0051587 | A1 | 2/2019 | Azeroual et al. | |
| 2019/0089098 | A1 | 3/2019 | Cheng et al. | |
| 2019/0089106 | A1 | 3/2019 | Regnier | |
| 2019/0097357 | A1 | 3/2019 | Mongold | |
| 2019/0131743 | A1 | 5/2019 | Hsu et al. | |
| 2019/0393634 | A1 | 12/2019 | Kao et al. | |
| 2020/0044395 | A1 | 2/2020 | Naganuma et al. | |
| 2020/0212631 | A1 | 7/2020 | Buck et al. | |
| 2020/0220279 | A1 | 7/2020 | Koellmann et al. | |
| 2020/0350731 | A1 | 11/2020 | Buck et al. | |
| 2021/0151934 | A1 | 5/2021 | Faith | |

FOREIGN PATENT DOCUMENTS

| | | | |
|---|---|---|---|
| CN | 200950498 | Y | 9/2007 |
| CN | 101171724 | A | 4/2008 |
| CN | 201117955 | Y | 9/2008 |
| CN | 101297441 | A | 10/2008 |
| CN | 201570699 | U | 9/2010 |
| CN | 201789145 | U | 4/2011 |
| CN | 102222828 | A | 10/2011 |
| CN | 301785292 | S | 1/2012 |
| CN | 102356520 | A | 2/2012 |
| CN | 103828129 | A | 5/2014 |
| CN | 104103931 | A | 10/2014 |
| CN | 303032002 | S | 12/2014 |
| CN | 104332767 | A | 2/2015 |
| CN | 105703157 | A | 6/2016 |
| CN | 106207534 | A | 12/2016 |
| EP | 1225664 | A2 | 7/2002 |
| JP | 5940898 | | 10/1984 |
| JP | 60-007258 | | 2/1985 |
| JP | 0985825 | | 12/1995 |
| JP | 09-085825 | A | 3/1997 |
| JP | 1206569 | | 4/2004 |
| JP | 2009-218119 | A | 9/2009 |
| JP | 1419110 | S | 7/2011 |
| JP | 2018-014964 | A | 2/2018 |
| JP | 1655265 | S | 3/2020 |
| JP | 1655173 | S | 8/2020 |
| KR | 0193346 | | 2/1997 |
| KR | 10-0193346 | B1 | 6/1999 |
| TW | 404579 | U | 9/2000 |
| TW | M328112 | U | 3/2008 |
| TW | D130799 | | 10/2008 |
| TW | D132453 | S1 | 12/2009 |
| TW | D163315 | | 9/2013 |
| TW | D172197 | | 4/2014 |
| TW | D166670 | | 3/2015 |
| TW | D168325 | | 6/2015 |
| TW | D168328 | | 6/2015 |
| TW | M519836 | U | 4/2016 |
| TW | D198418 | S | 7/2019 |
| WO | 2013/155147 | A1 | 10/2013 |
| WO | 2015/116407 | A1 | 8/2015 |
| WO | 2017/218771 | | 12/2017 |
| WO | 2018/231896 | A1 | 12/2018 |
| WO | 2019/018728 | A1 | 1/2019 |
| WO | 2019/084110 | A1 | 5/2019 |

OTHER PUBLICATIONS

"Credo demonstrates 112 G PAM4 SR, 56G PAM4 LR, and 56G NRZ Serdes Technology at DesignCon", Credo Semiconductor, Jan. 30, 2017, 6 pages.

Amphenol TCS, "PAL 4×8 POS, 30AWG, 40GHz CBL ASSY", Part No. HS30720-XXX, Drawing No. CHS30720500, dated Oct. 31, 2017, 3 pages.

Gannon, "TE Connectivity introduces cabled STRADA Whisper connectors", Aug. 23, 2017, pp. 1-7, https://www.connectortips.com/te-connectivity-introduces-cabled-strada-whisper-connectors/.

Har-bus Connectors, p. 5, (JPO Division of Design, Official Gazette Known Data No. HD13004493), Harting KGaA, Acceptance Date—Mar. 16, 2001.

TE Connectivity introduces cabled STRADA Whisper connectors, Connector Tips, https://www.connectortips.com/te-connectivity-introduces-cabled-strada-whisper-connectors/, website accessed Jul. 20, 2020.

Samtec, Examax Backplane Cable, Drawing No. EBCM-X-4-xX-x-x-x-XX-X-XX-X, Revision F, Jun. 2, 2017, 7 pages.

Samtec, Examax Backplane Cable, Drawing No. EBCM-X-6-XX-X-X-X-XX-X-XX-X, Revision F, Apr. 10, 2017, 7 pages.

* cited by examiner

ELECTRICAL CONNECTOR HAVING LATCH

CROSS-REFERENCE TO RELATED APPLICATIONS

This is a continuation of U.S. patent application Ser. No. 16/632,720 filed Jan. 21, 2020, which is the National Stage of International Patent Application No. PCT/US2018/043025 filed Jul. 20, 2018, which claims the benefit of U.S. Patent Application Ser. No. 62/535,729 filed Jul. 21, 2017 and U.S. Patent Application Ser. No. 62/622,370 filed Jan. 26, 2018, the disclosure of each of which is hereby incorporated by reference as if set forth in its entirety herein.

BACKGROUND

Electrical connectors generally include electrically insulative connector housings and electrical contacts supported by the connector housings. The electrical connectors mate with each other so as to establish an electrical path therebetween. Accordingly, when the mated electrical connectors are mounted to respective electrical components, the electrical components are placed in electrical communication with each other. Examples of such electrical components include electrical cables and substrates such as printed circuit boards.

It can be desirable to provide latching mechanisms that releasably secure the electrical connectors to each other when the electrical connectors are mated, thereby ensuring that the mated electrical connectors define a reliable electrical path between the electrical components.

SUMMARY

In one example, a latch is configured to secure a first electrical connector to a complementary second electrical connector to when the first electrical connector is mated to the second electrical connector along a mating direction. The latch can include an attachment portion configured to be attached to a connector housing of the first electrical connector. The latch can further include an engagement portion configured to engage a second latch of the second electrical connector, and an engagement member supported by the engagement portion. The latch can further include a hinge that extends from the attachment portion to the engagement portion. The engagement member can be movable about the hinge with respect to the attachment portion between an engaged position and a disengaged position. The latch can further include a biasing member that is configured to apply a biasing force to the engagement portion that biases the engagement portion to move in an engagement direction toward the engaged position.

DETAILED DESCRIPTION

Figure 1A:
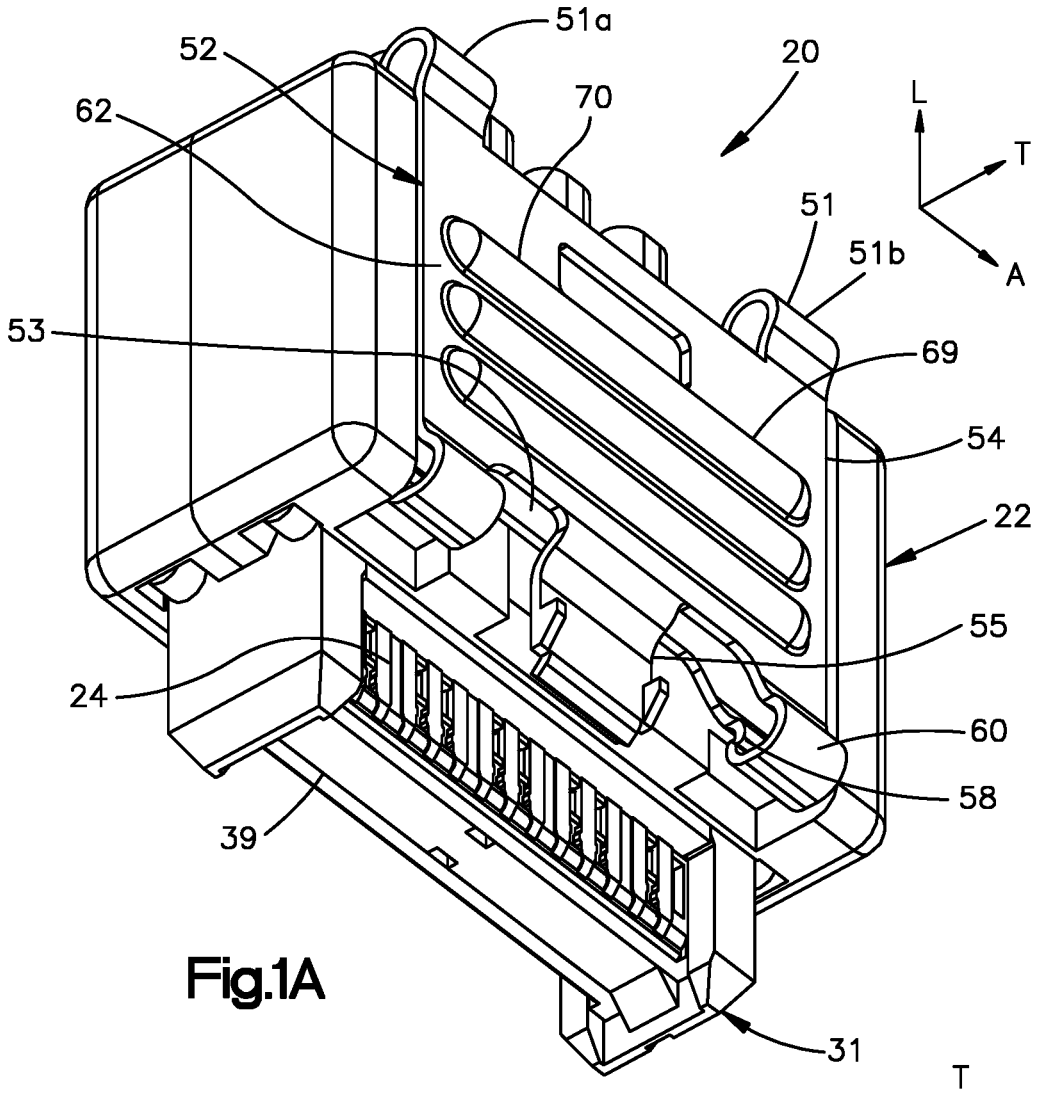
FIG. 1A is a perspective view of a first electrical connector constructed in accordance with one example, the first electrical connector including a latch.
Figure 1B:
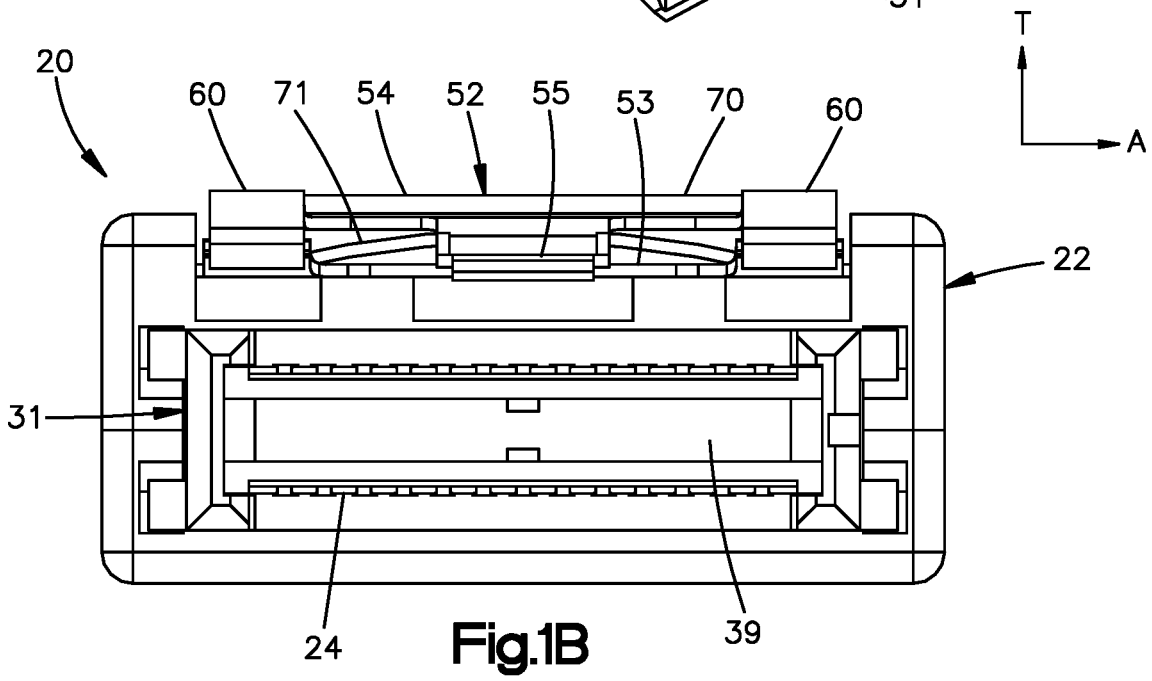
FIG. 1B is a front elevation view of the first electrical connector illustrated in FIG. 1A.

Referring to FIGS. 1A-2C, an electrical connector 20 can include an electrically insulative connector housing 22 and a plurality of electrical contacts 24 supported by the connector housing 22. The electrical contacts 24 define mating ends 25 and mounting ends 27 opposite the mating ends 25. The mating ends 25 can be configured to mate with complementary second electrical contacts of a complementary second electrical connector 100 when the electrical connectors 20 and 100 are mated to each other (see FIG. 4 below). In this regard, the electrical connector 20 can be referred to as a first electrical connector. Further, components of the electrical connector 20 can be referred to as "first" components unless otherwise indicated. Components of the second electrical connector can be referred to as "second" components unless otherwise indicated.

In one example, the electrical contacts 24 can be configured as vertical contacts whereby the mating ends 25 and the mounting ends 27 are inline with each other. For instance, the mating ends 25 and the mounting ends 27 can be disposed opposite each other with respect to a longitudinal direction L. Thus, the first electrical connector 20 can be referred to as a vertical electrical connector. Alternatively, the electrical contacts 24 can be configured as right-angle contacts whereby the mating ends 25 and the mounting ends 27 are oriented substantially perpendicular to each other. When the electrical contacts 24 are configured as right-angle contacts, the electrical connector 20 can be referred to as a right-angle electrical connector.

Figure 5A:
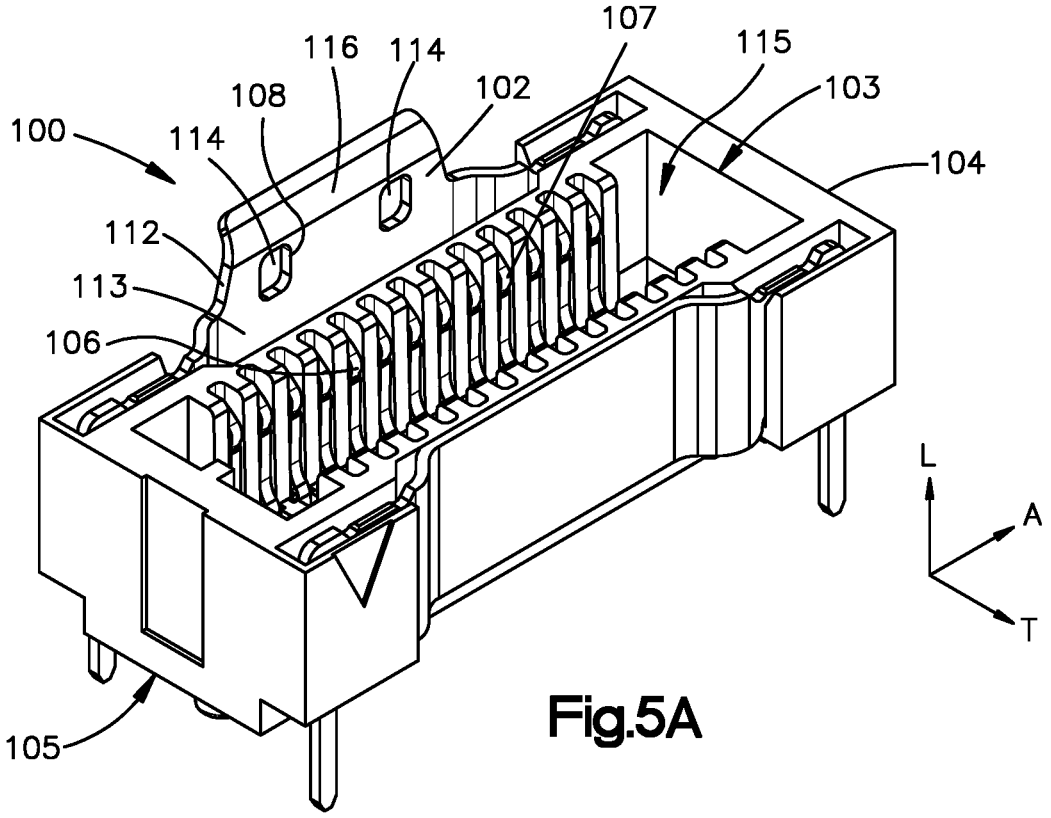
FIG. 5A is a perspective view of the second electrical connector illustrated in FIG. 4.

The electrical connector 20 can define a first mating interface 31 that is configured to engage a complementary second mating interface 103 of the second electrical connector 100 (see FIG. 5A). The mating ends 25 can be disposed at the mating interface 31. In one example, the first mating interface 31 can be configured as a plug 39 that is configured to be inserted into the second mating interface 103 so as to mate the electrical connectors 20 and 100 to each other. Thus, the first mating interface 31 can be configured to be received by the second mating interface 103 so as to mate the electrical connectors 20 and 100 to each other. Alternatively, the first mating interface 31 can be configured as a receptacle that is configured to receive the second mating interface 103 so as to mate the electrical connectors 20 and 100 to each other.

The electrical connector 20 defines a mounting interface 63. The mounting ends 27 of the electrical contacts 24 can be disposed at the mounting interface 63. The electrical connector 20 can be mounted to a complementary electrical component at the mounting interface 63. The complementary electrical component can be configured as a plurality of electrical cables 67 that extend out from the mounting interface 63. The electrical contacts are configured to be mounted to respective ones of the electrical cables 67 at the mounting ends 27. For instance, electrical conductors and grounds of the electrical cables can extend out from respective ones of the mounting ends 27 of the electrical contacts 24. Thus, when the electrical connector 20 is configured as a vertical electrical connector, the mounting interface 63 can be oriented parallel with the mating interface 31. Further, the mounting interface 63 can be opposite the mating interface 31 along the longitudinal direction L. Thus, the mounting interface 63 can be defined at a rear end of the electrical connector. Alternatively, when the electrical connector 20 is configured as a right angle electrical connector, the mounting interface can be disposed at a bottom of the electrical connector 20. It should be appreciated that the electrical connector 20 can be mounted to any suitable complementary electrical component as desired. For instance, the complementary electrical component can alternatively be configured as a substrate, such as a printed circuit board, as desired, and as described below with respect to the second electrical connector 100.

The mating interface 31 can be said to be at a front end of the first electrical connector 20. Thus, reference to a "forward direction" or "front" with respect to the first electrical connector 20 and components thereof can be interpreted with respect to a forward direction from the rear end to the front end. Conversely, reference to a "rearward direction" or "rear" with respect to the first electrical connector 20 and components thereof can be interpreted with respect to a rearward direction from the front end to the rear end of the first electrical connector 20. Thus, the forward direction and the rearward direction can be opposite each other along the longitudinal direction L.

The first electrical connector 20 can be configured to mate with the second electrical connector 100 by moving the first electrical connector 20 in a mating direction with respect to the second electrical connector 100. This can be accomplished by moving the first electrical connector 20 toward the second electrical connector 100 in the forward direction, moving the second electrical connector 100 toward the first electrical connector 20, or both. Thus, the mating direction of the first electrical connector 20 can be in the forward direction. The first electrical connector 20 can be configured to unmate from the second electrical connector 100 by moving the first electrical connector 20 in an unmating direction with respect to the second electrical connector 100. The unmating direction can be opposite the mating direction. This can be achieved by moving the first electrical connector 20 away from the second electrical connector 100 in the rearward direction, moving the second electrical connector 100 away from the first electrical connector 20, or both. Thus, the unmating direction of the first electrical connector 20 can be in the rearward direction. The mating direction and the unmating direction can be oriented along the longitudinal direction L.

As will be described in more detail below, the first electrical connector 20 can include a first latch 52 that is configured to releasably engage a complementary second latch 102 of the second electrical connector 100 so as to releasably secure the first electrical connector 20 to the second electrical connector 100 when the first and second electrical connectors 20 and 100 are mated to each other. In particular, the first and second latches 52 and 102 can interlock with each other when the first and second electrical connectors 20 and 100 are mated to each other, and can resist unmating of the first and second electrical connectors 20 and 100. The first and second latches 52 and 102 can be disengaged from each other so as to allow the first and second electrical connectors 20 and 100 to unmate from each other.

The first electrical connector 20 can include at least one leadframe assembly 35 that includes a leadframe housing 23 that supports ones of the plurality of electrical contacts 24. In one example, the first electrical connector 20 can include a plurality of leadframe assemblies 35. Because the electrical contacts 24 are supported by a respective one of the leadframe housings 23 which, in turn, are supported by the connector housing 22, it can be said that the electrical contacts 24 are supported by the connector housing 22. The leadframe housing 23 can be electrically insulative. In one example, the electrical contacts 24 can be insert molded in the respective leadframe housing 23. Thus, the leadframe assemblies 35 can be referred to as insert molded leadframe assemblies (IMLAs). Alternatively, the electrical contacts 24 can be stitched into the respective leadframe housings 23. Alternatively still, the electrical contacts 24 can be supported directly by the connector housing 22 without being supported by an intervening leadframe housing.

The electrical contacts 24 can be arranged along respective columns 27 that are spaced from each other along a transverse direction T that is perpendicular to the longitudinal direction L. For instance, the electrical connector 20 can include a pair of columns of electrical contacts 24 spaced from each other along the transverse direction T. The electrical contacts 24 of each of the columns 27 can be spaced from each other along the lateral direction A that is perpendicular with respect to both the longitudinal direction L and the transverse direction T. Thus, the mating ends 25 of a first one of the columns 27 of electrical contacts 24 can be disposed at a first side of the first mating interface 31, and the mating ends 25 of a second one of the columns 27 of the electrical contacts 24 can be disposed at a second side of the mating interface 31 that is opposite the first side along the transverse direction T. The mating ends 25 of the electrical contacts 24 of each column 27 can be spaced from each other and aligned with each other along a column direction 37. The column direction 37 can be oriented along the lateral direction A.

The electrical contacts 24 can include signal contacts 26 and ground contacts 28. The signal and ground contacts 26 and 28 can be aligned with each other along the respective column 27. That is, the signal and ground contacts 26 and 28 of a respective column can be aligned with each other along the lateral direction A. The signal and ground contacts 26 and 28 can be arranged in any pattern along the column 27 as desired. For instance, the signal and ground contacts 26 and 28 can be arranged in a repeating S-S-G pattern along the column 27. Alternatively, the signal and ground contacts 26 and 28 can be arranged in a repeating S-G-S pattern along the column 27. Alternatively still, the signal and ground contacts 26 and 28 can be arranged in a repeating G-S-S pattern along the column 27. Alternatively still, the signal and ground contacts 26 and 28 can be arranged in a repeating G-G-S-S pattern along the column 27. As described above, "S" represents a signal contact, and "G" represents a ground contact.

The signal contacts 26 can include at least one pair, such as a plurality of pairs or, first and second signal contacts 26*a* and 26*b*, respectively, that are immediately adjacent each other along the lateral direction A. The term "immediately adjacent" as used with respect to the first and second signal contacts 26*a* and 26*b* means that no intervening electrical contacts are disposed between and aligned with the immediately adjacent first and second signal contacts 26*a* and 26*b* along the respective column 27. The pairs of immediately adjacent first and second ones of the signal contacts 26 along the lateral direction A can define differential signal pairs. Alternatively, the signal contacts 26 can be single ended. The ground contacts 28 can include a first ground contact 28*a* that is immediately adjacent the first signal contact 26*a*, such that the first signal contact 26*a* is disposed between the first ground contact 28*a* and the second signal contact 26*b*.

The electrical contacts 24 can define first and second edges spaced from each other along the lateral direction A, and first and second broadsides that are spaced from each other along the transverse direction T. The broadsides can be longer than the edges in a plane that intersects the electrical contacts. For instance, the plane can be defined by the lateral direction A and the transverse direction T at the mating ends 25.

Figure 2A:
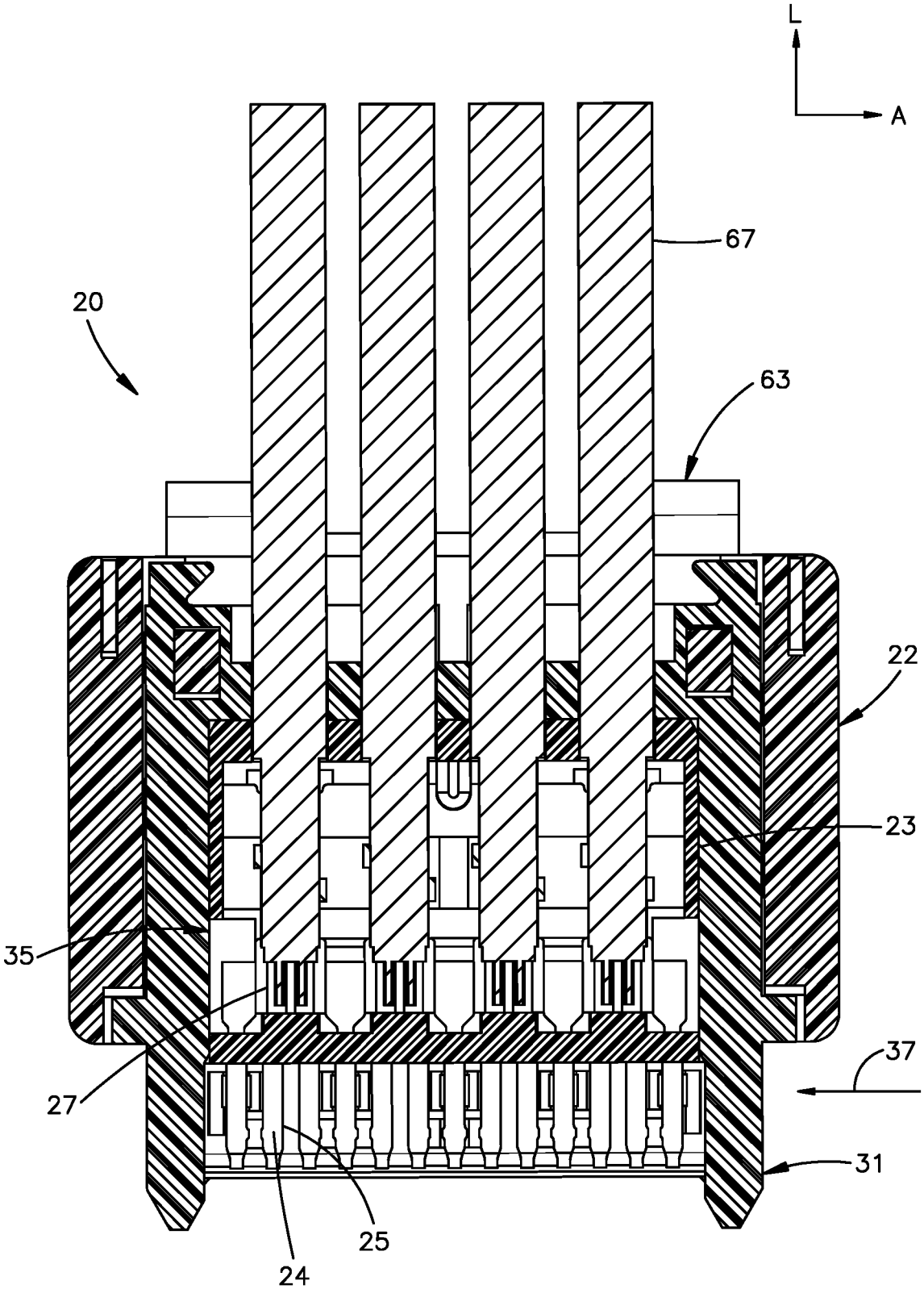
FIG. 2A is a sectional top plan view of the electrical connector illustrated in FIG. 1, shown mounted to a plurality of electrical cables.
Figure 2B:
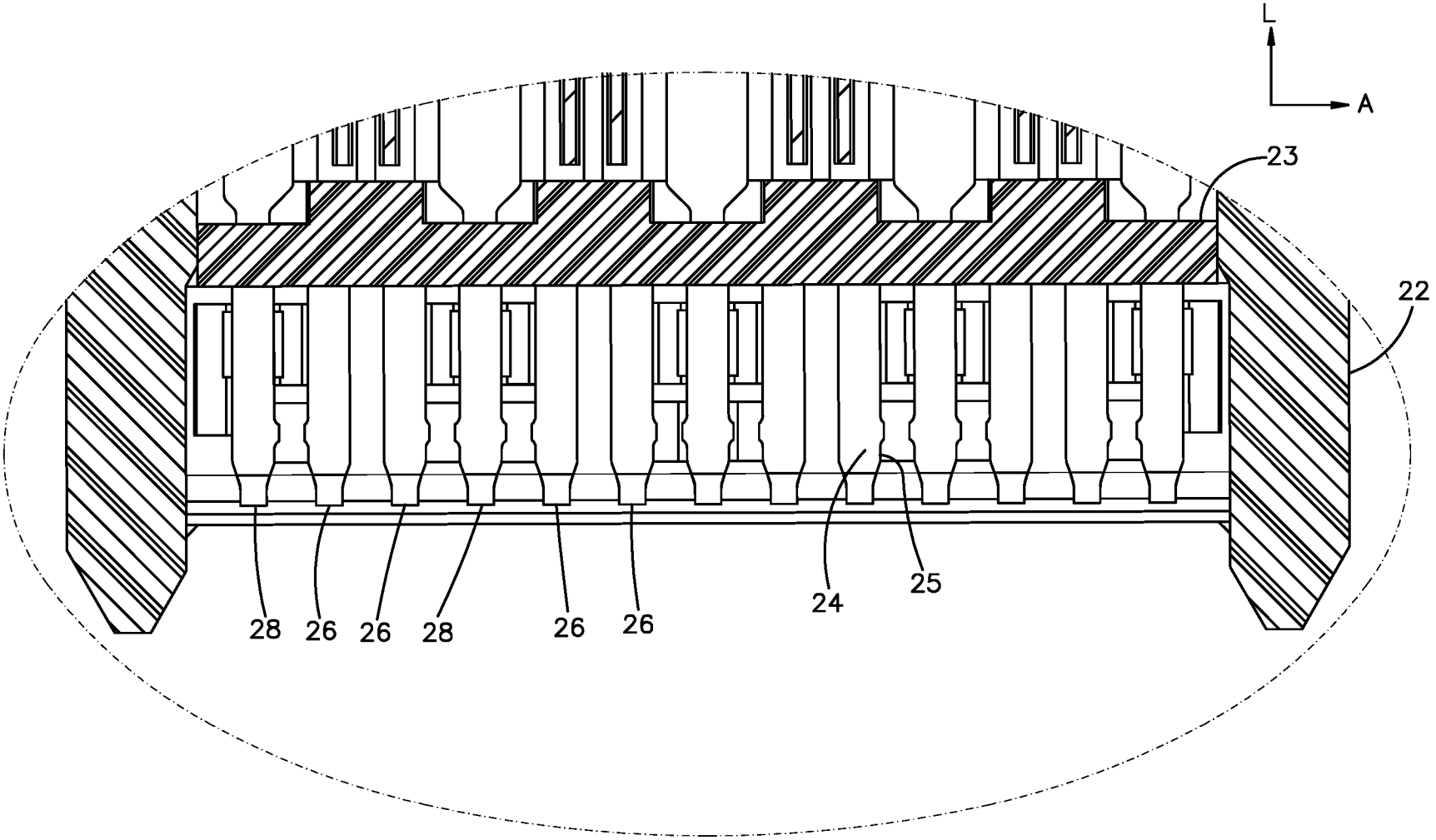
FIG. 2B is an enlarged view of a region of the electrical connector illustrated in FIG. 2A.
Figure 2C:
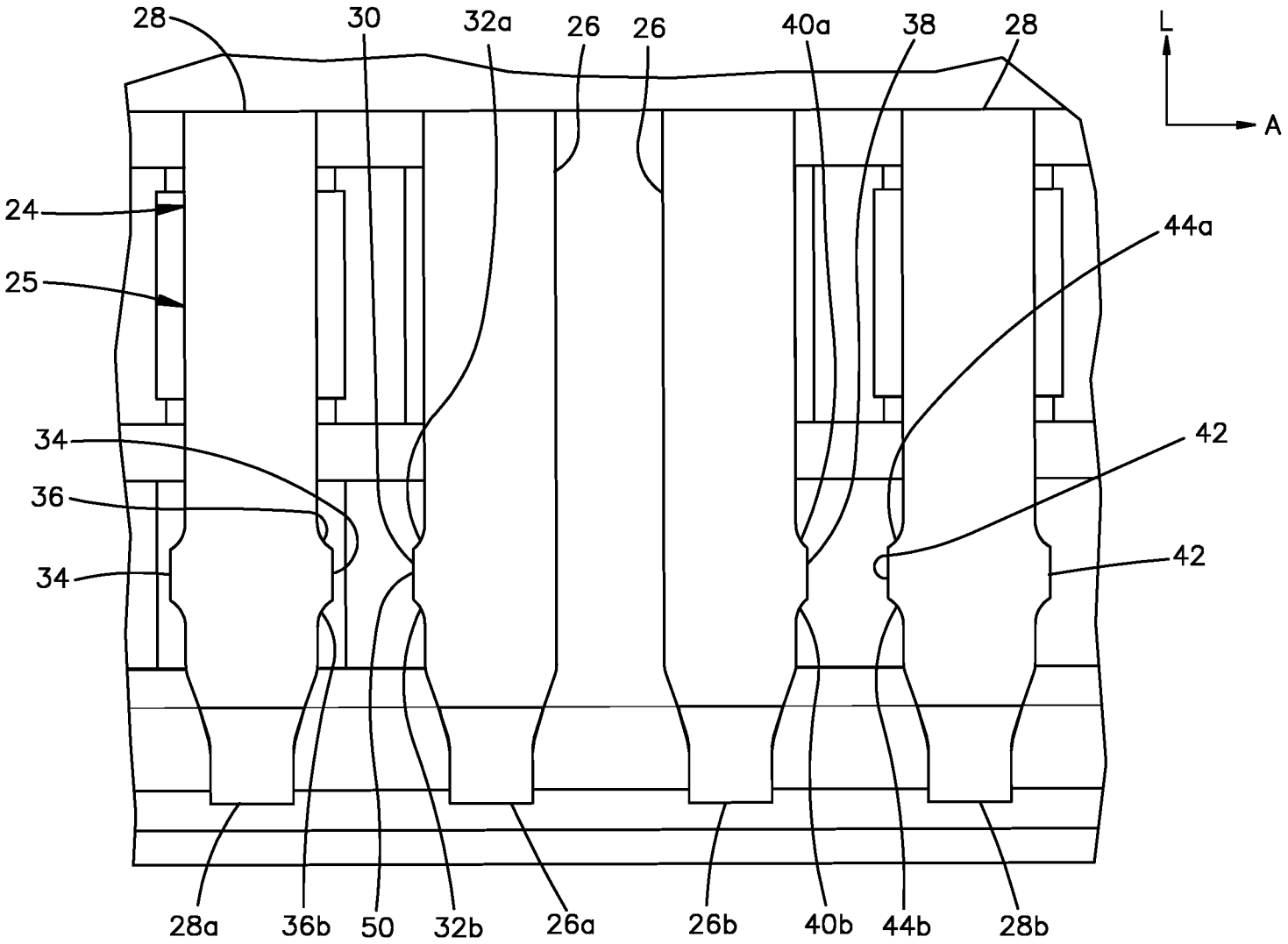
FIG. 2C is a further enlarged view of a region of the electrical connector illustrated in FIG. 2A.

Referring now to FIG. 2C in particular, the first signal contact 26*a* can define a first signal projection 30 that extends toward the first ground contact 28*a* along the lateral direction A. The first signal projection 30 terminates without touching the first ground contact 28*a*. The first signal projection 30 can be disposed at the mating end of the first signal contact. The first signal projection 30 can define first and second shoulders 32*a* and 32*b* that each extend out toward the first ground contact 28*a*. The first and second shoulders 32*a* and 32*b* can be spaced from each other along the longitudinal direction L. The first signal projection can be spaced from a terminal tip of the mating end of the first signal contact.

In one example, one of the edges of the first signal contact 26*a* that faces the first ground contact 28*a* can define the projection 30. The broadsides of the first signal contact 26*a* at the mating end 25 can be coplanar with the first signal projection 30. In particular, the broadsides can be planar along a direction that includes the lateral direction A and the longitudinal direction L. The broadsides of the electrical contacts in a given column 27 can all be coplanar with each other.

The first ground contact 28*a* can similarly define a first ground projection 34 that extends toward the first signal contact 26*a* along the lateral direction A, and terminates without touching the first signal contact 26*a*. In particular, one of the edges of the first ground contact 28*a* that faces the first signal contact 26*a* defines the first ground projection 34. The broadsides of the first ground contact 28*a* can be coplanar with the first ground projection 34. The first ground projection 34 can define a first shoulder 36*a* and a second shoulder 36*b* that each extend out toward the first signal contact 26*a*. The first and second shoulders 36*a* and 36*b* can be spaced from each other along the longitudinal direction L. The first ground projection 34 can be disposed at the mating end of the first ground contact 28*a*. For instance, the first ground projection 34 can be spaced from a terminal tip of the mating end of the first ground contact 28*a*. The first ground projection 34 can be aligned with the first signal projection 30 along the lateral direction A. Further, the first ground projection 34 and the first signal projection 30 can be mirror images of each other.

The first signal contact 26*a* and the first ground contact 28 define a first distance from the first ground projection 34 to the first signal projection 30 along the lateral direction A. The first signal contact 26*a* and the first ground contact 28 define a second distance from a remainder of the edge of the first ground contact 28*a* that defines the first ground projection 34 to a remainder of the edge of the first signal contact 26*a* that defines the first signal projection 30 along the lateral direction A. The second distance is greater than the first distance.

In one example, the edge of the first signal contact 26*a* that faces the second signal contact 26*b* can be devoid of a projection that extends toward the second signal contact 26*b* along the lateral direction A at the mating end of the first signal contact 26*a*. For instance, the edge of the first signal contact 26*a* that faces the second signal contact 26*b* can be substantially planar at the mating end. Similarly, the edge of the second signal contact 26*b* that faces the first signal contact 26*a* can be devoid of a projection that extends toward the first signal contact 26*a* along the lateral direction A at the mating end of the second signal contact 26*b*. For instance, the edge of the second signal contact 26*b* that faces the first signal contact 26*a* can be substantially planar at the mating end.

The electrical contacts 24 can define a second ground contact 28*b* that is disposed immediately adjacent the second signal contact 26*b*. Thus, the second signal contact 26*b* can be disposed between the first signal contact 26*a* and the second ground contact 28*b*. The second signal contact 26*b* can define a second signal projection 38 that extends toward the second ground contact 28*b* along the lateral direction A, and terminates without touching the second ground contact 28*b*. For instance, the one of the edges of the second signal contact 26*b* that faces the second ground contact 28*b* can define the second signal projection 38. The broadsides of the second signal contact 26*b* can be coplanar with the second signal projection 38.

The second signal projection 38 can define a first shoulder 40*a* and a second shoulder 40*b* that each extend out toward the second ground contact 28*b*. The first and second shoulders 40*a* and 40*b* can be spaced from each other along the longitudinal direction L. The second signal projection 38 can be disposed at the mating end of the second signal contact 26*b*. For instance, the second signal projection 38 can be spaced from a terminal tip of the mating end of the second signal contact 26*b*. All shoulders of all projections can terminate at a free end 50. The free end 50 of all projections can be substantially parallel (e.g., within manufacturing tolerances) to each other in one example.

Similarly, the second ground contact 28*b* can define a second ground projection 42 that extends toward the second signal contact 26*b* along the lateral direction A, and terminates without touching the second signal contact 26*b*. In particular, one of the edges of the second ground contact 28*b* that faces the second signal contact 28*b* can define the second ground projection. The broadsides of the second ground contact 28*b* can be coplanar with the second ground projection 42. The second ground projection 42 can define a first shoulder 44*a* and a second shoulder 44*b* that each extend out toward the second signal contact 28*b*. The first and second shoulders 44*a* and 44*b* can be spaced from each other along the longitudinal direction L. The second ground projection 42 can be disposed at the mating end of the second ground contact 28*b*. For instance, the second ground projection 42 can be spaced from a terminal tip of the mating end of the second ground contact 28*b*. The second ground projection 42 can be aligned with the second signal projection 38 along the lateral direction A. Further, the second ground projection 42 can be aligned with the first ground projection 34 along the lateral direction A. The second ground projection 42 and the second signal projection 38 can be mirror images of each other.

The signal contacts 26 can include a plurality of pairs of first and second signal contacts 26*a* and 26*b*, each pair separated by a ground contact 28. For instance, the first ground contact 28*a* can be disposed between first and second pairs of signal contacts 26, and the second ground contact 28*b* can be disposed between second and third pairs of signal contacts 26. The first ground contacts 28*a* can each define a respective pair of first ground projections 34 that extend in a direction away from each other along the lateral direction A from opposed edges of the respective first ground contact 28*a*. Thus, the projections 34 can extend toward respective different ones of the signal contacts 26 of the first and second pairs that are disposed immediately adjacent the respective ground contact. Similarly, the second ground contacts 28*b* can each define a respective pair of second ground projections 42 that extend in a direction away from each other along the lateral direction A from opposed edges of the respective second ground contact 28*b*. Thus, the projections 42 can extend toward respective different ones of the signal contacts 26 of the second and third pairs that are disposed immediately adjacent the respective second ground contact 28*b*.

A plane can extend from the center of the terminal tip of the mating end 25 and through the mating end. The plane can be defined by both the longitudinal direction L and the transverse direction T. Thus, one of the edges of the first signal contact 26*a* is at a first side of the plane with respect to the lateral direction A, and the other of the edges of the first signal contact 26*a* is at a second side of the plane with respect to the lateral direction. Because the first signal contact 26*a* includes the first signal projection 30 at only one of its edges, the first signal projection 30 causes the first side that faces the first ground contact 28*a* to have a greater volume than the second side that faces the second signal contact 26*b*. Similarly, because the second signal contact 26*b* includes the second signal projection 38 at only one of its edges, the second signal projection 38 causes the first side that faces the second ground contact 28*b* to have a greater volume than the second side that faces the first signal contact 26*a*.

In one example, all signal of the contacts 26 that are disposed immediately adjacent a respective ground contact 28 can define a respective signal projection that extends toward the immediately adjacent ground contact 28. Further, all ground contacts 28 that are disposed adjacent a respective immediately adjacent signal contact can defines a respective ground projection that extends toward the immediately adjacent signal contact. Further in one example, none of the signal contacts 26 disposed immediately adjacent a respective different one of the signal contacts 26 defines a projection that extends out along the lateral direction A toward the adjacent one of the signal contacts 26.

Figure 3B:
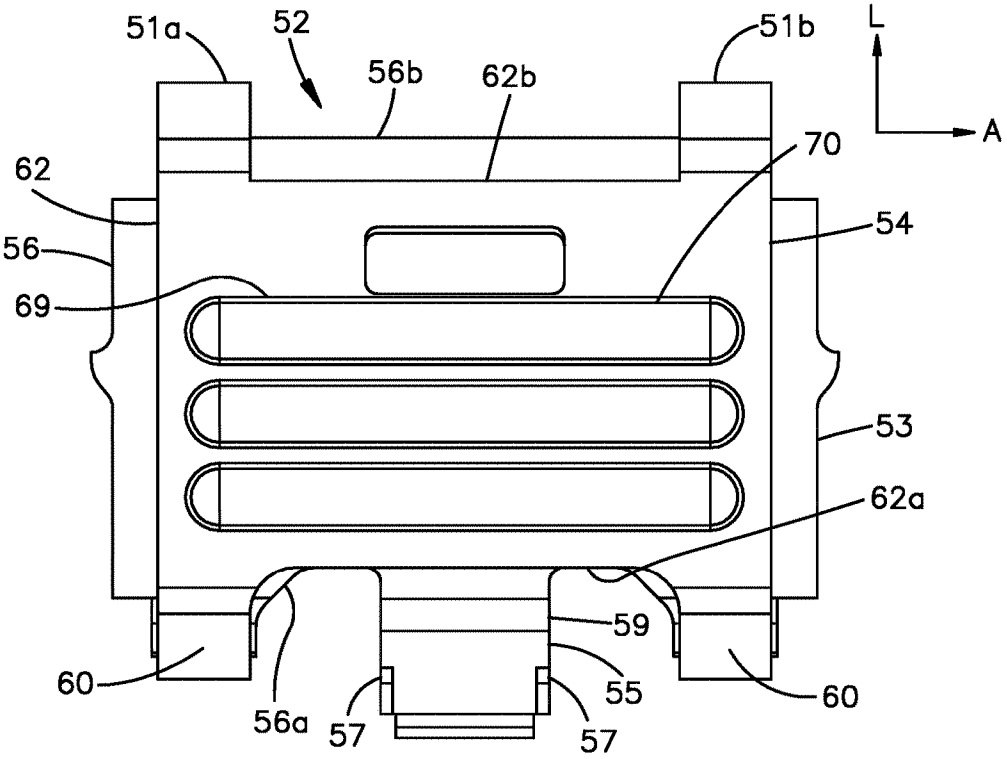
FIG. 3B is a front elevation view of the latch illustrated in FIG. 3A.
Figure 3C:
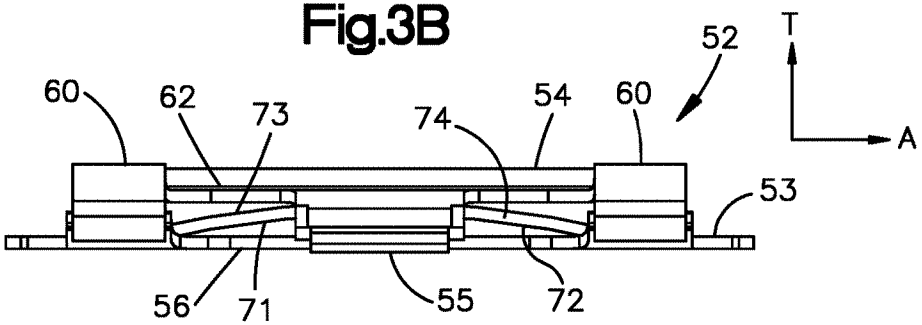
FIG. 3C is a top plan view of the latch illustrated in FIG. 3A.
Figure 3A:
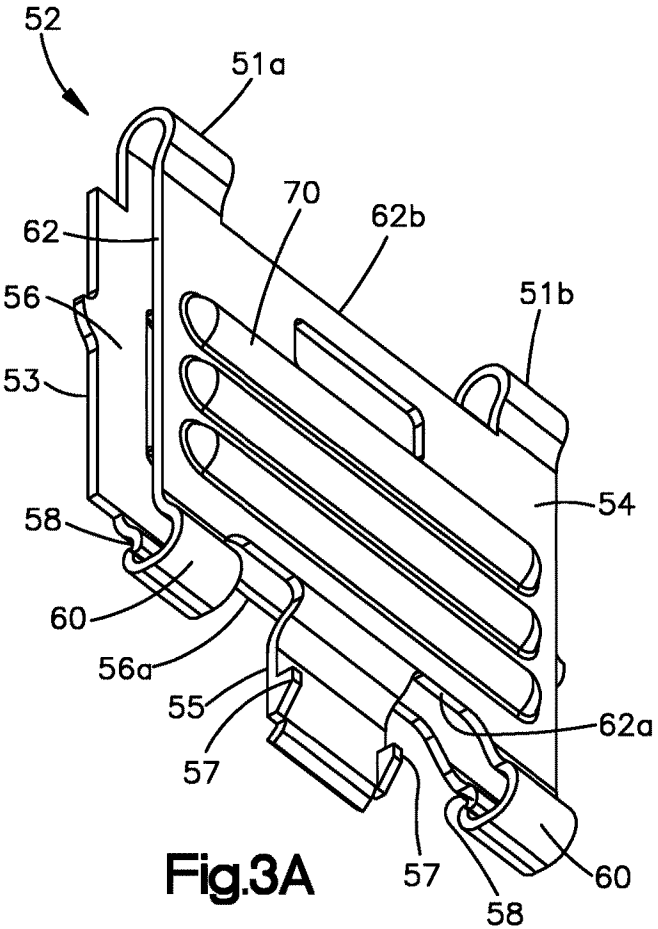
FIG. 3A is a perspective view of the latch of the first electrical connector illustrated in FIG. 1A.
Figure 3D:
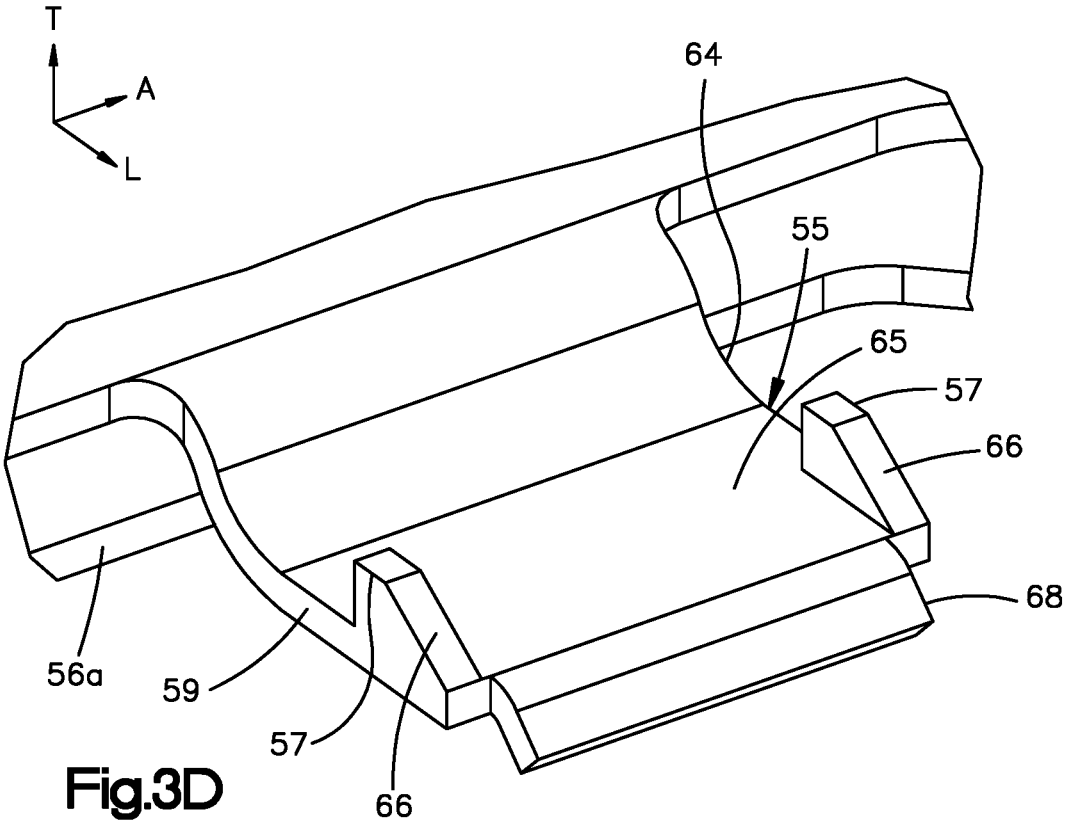
FIG. 3D is an enlarged perspective view of an engagement member of the latch illustrated in FIG. 3A.
Figure 3E:
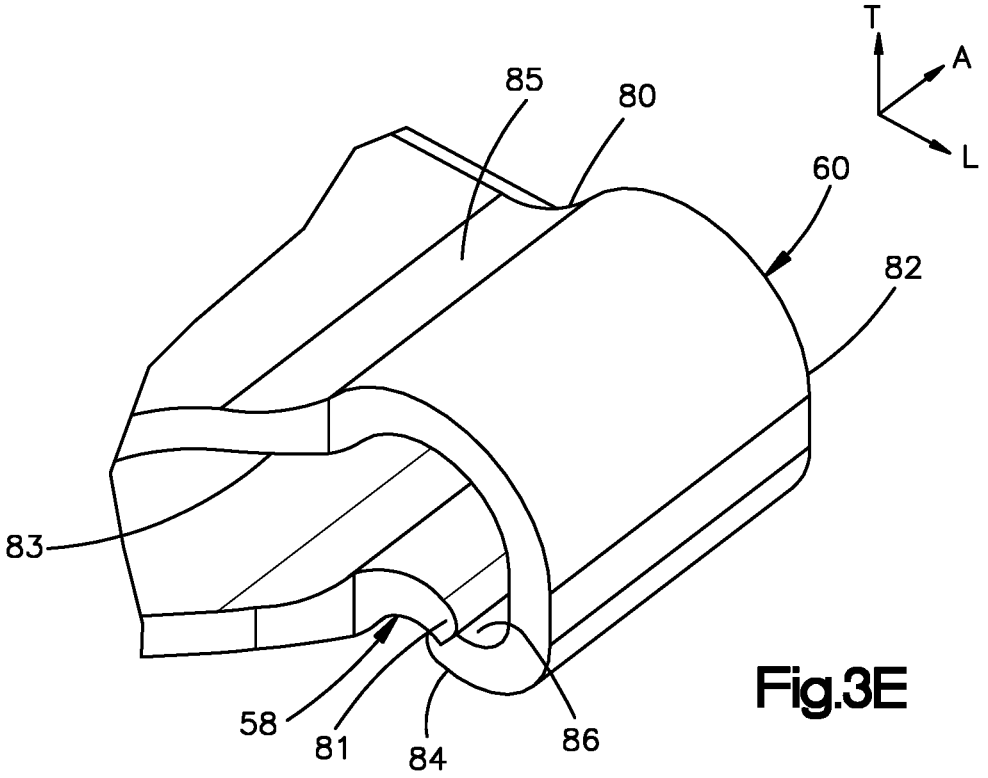
FIG. 3E is an enlarged perspective view of a portion of the latch illustrated in FIG. 3A, showing first and second stop members.
Figure 4:
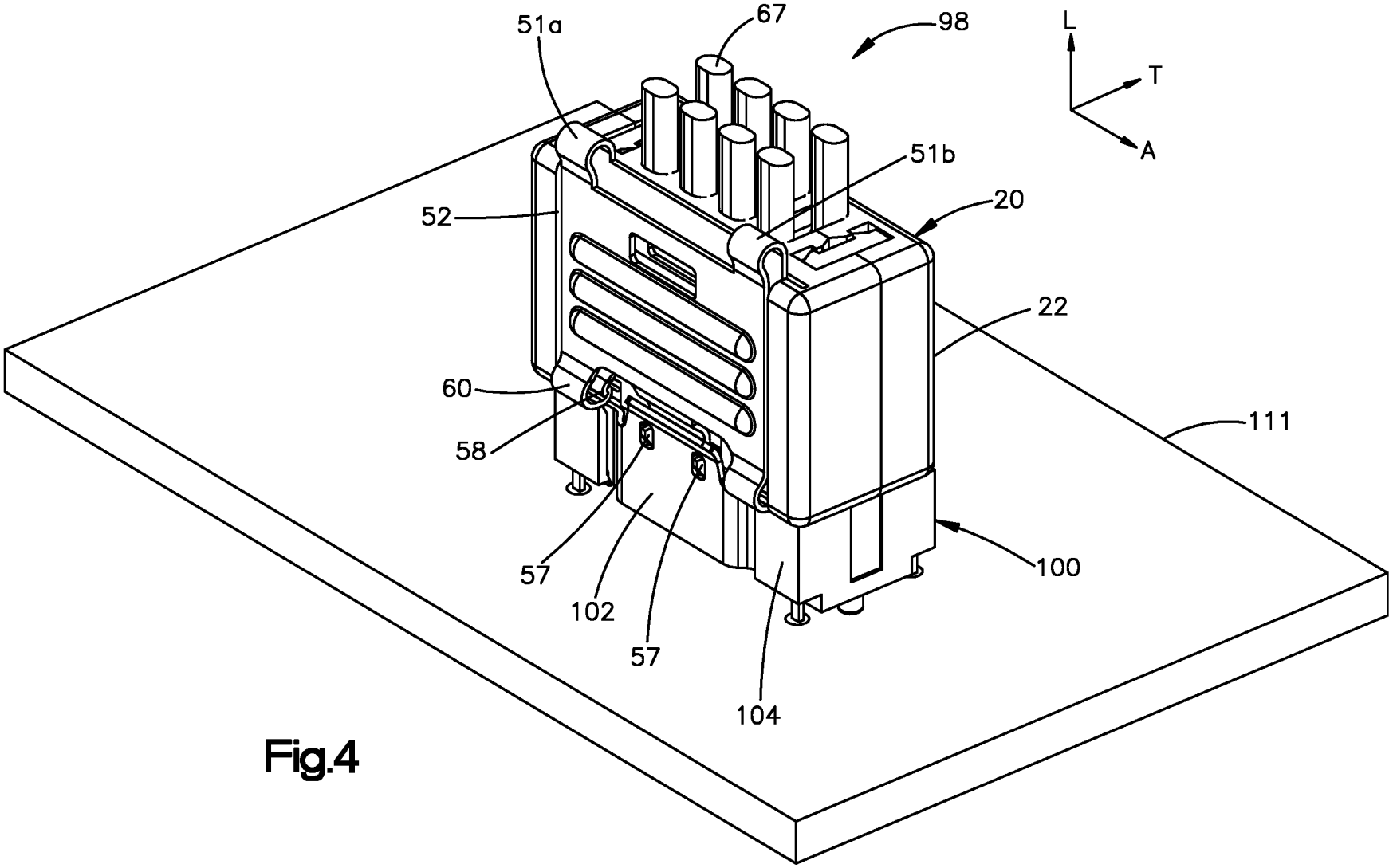
FIG. 4 is a perspective view the first electrical connector illustrated in FIG. 1 mated with a second electrical connector.

Referring now to FIGS. 1A-1B and 3A-3E, the first latch 52 is configured to attach to the first connector housing 22 and is configured to engage the second latch 102 of the second electrical connector 100 (see FIG. 4). It should therefore be appreciated that the first latch 52 is not part of the first connector housing 22. In particular, the first latch 52 can include a first attachment portion 53 that is configured to attach to the connector housing 22. The first latch 52 can further include a first engagement portion 54 that is configured to engage a second engagement portion of the second latch 102 so as to attach the first latch 52 to the second latch 102. Thus, as will be appreciated from the description below, the first attachment portion 53 and the first engagement portion 54 can be structurally different from each other. The first engagement portion 54 can be configured to releasably engage the second engagement portion of the second latch 102, as described in more detail below. In particular, the first latch 52 can further include at least one first engagement member 55 that is supported by the first engagement portion 54 and is configured to engage a second engagement member of the second latch 102 so as to releasably secure the first electrical connector 20 to the second electrical connector 100. Thus, when the first engagement member 55 engages the second engagement member of the second latch 102, the engagement portion 54 can be said to engage the second engagement portion of the second latch 102. As will be described in more detail below, the first engagement member 55 can be configured as a projection 57 in one example that is received by an aperture of the second latch 102 so as to engage the first and second latches 52 and 102.

In one example, the attachment portion 53 can define an attachment body 56. The attachment body 56 can define a front end 56*a* and a rear end 56*b* opposite the front end 56*a* along the rearward direction. The attachment body 56 can be oriented substantially along a plane that is defined by the lateral direction A and the longitudinal directions L. In this regard, the attachment body 56 can define a plate. The term "substantially" and "approximately" as used herein can mean within 20% of the ranges and values, and orientations described herein. The attachment portion 53 can be attached to the connector housing 22 in any suitable manner as desired. For instance, in one example, the attachment portion 53 can be insert molded in the connector housing 22. Alternatively, the attachment portion 53 can be adhesively attached to the connector housing 22. Alternatively still, the attachment portion 53 can be inserted into a retention slot of the connector housing 22. For instance, the attachment portion 53 can be press-fit into a retention slot of the connector housing 22. In one example, the attachment portion 53 can include one or more barbs that project out along the lateral direction A so as to engage the connector housing 22.

The engagement portion 54 can be offset from the attachment portion 53 along the transverse direction T. In particular, the attachment portion 53 can be disposed between the connector housing 22 and the engagement portion 54 along the transverse direction T. When the first electrical connector 20 and latch 52 is oriented as illustrated, the engagement portion 54 can be said to be spaced above the attachment portion 53 along the transverse direction T. Conversely, the attachment portion 53 can be said to be spaced below the engagement portion along the transverse direction. Thus, while it is appreciated that the orientation of the first electrical connector 20 can change during use, the terms "up," "upward direction," "above," and derivatives thereof are used herein with reference to a direction from the attachment portion 53 to the engagement portion 54 for the purposes of clarity and convenience. The terms "down," "downward direction," "below," and derivatives thereof are used herein with reference to a direction from the engagement portion 54 to the attachment portion 53 for the purposes of clarity and convenience. Thus, it can be said that the latch 52 can be attached to an upper end of the connector housing 22 regardless of the orientation of the electrical connector 20 during use. Further, the transverse direction T can be referred to as a vertical direction. The lateral direction A and the longitudinal direction L can each be said to extend along a horizontal direction.

In one example, the engagement portion 54 can be configured as an engagement body 62. The engagement body 62 can define a front end 62*a* and a rear end 62*b* opposite the front end 62*a* along the rearward direction. The attachment body 56 and the engagement body 62 can be spaced from each other along the transverse direction T. In this regard, the attachment body 56 can define a plate. In particular, the engagement body 62 can be spaced above the attachment body 56. The engagement body 62 can be oriented along a respective plane that can vary during operation. The engagement portion 54 can be movable between an engaged position and a disengaged position. In particular, the engagement portion 54 can be movable along a disengagement direction from the engaged position to the disengaged position. The engagement portion 54 can further be movable along an engagement direction from the disengaged position to the engaged position. When the engagement portion 54 is in the engaged position, the first latch 52 is configured to be engaged with the second engagement portion of the second electrical connector 100. When the engagement portion 54 is engaged with the second engagement portion of the second latch 102, the first and second latches 52 and 102 can secure the first electrical connector 20 to the second electrical connector 100 when the first and second electrical connectors 20 and 100 are mated to each other. When the engagement portion 54 is in the disengaged position, the first and second latches 52 and 102 do not prevent the first and second electrical connectors 20 and 100 from being unmated from each other. Thus, it can be said that when the engagement portion 54 is in the engaged position, the first latch 52 is in the engaged position. Similarly, when the engagement portion 54 is in the engaged position, the engagement member 55 can be said to be in the engaged position. Similarly, when the engagement portion 54 is in the disengaged position, the engagement member 55 can be said to be in the disengaged position. Thus, reference to any of the engagement portion 54, the engagement member 55, and the latch 52 as being in the engaged position, the disengaged position, or moving between the engaged position and the disengaged position can equally apply to any other one or more of the engagement portion 54, the engagement member 55, and the latch 52.

In one example, when the engagement portion 54 is in the engaged position, the respective plane can be defined by the longitudinal direction L and the lateral direction A. When the engagement portion 54 is in a disengaged position, the respective plane can be defined by the lateral direction A and a second direction that includes a first directional component that is defined by the longitudinal direction L and a second directional component that is defined by the transverse direction T. Thus, the respective plane when the engagement portion 54 is in the disengaged position can be angularly offset with respect to the respective plane when the engagement portion 54 is in the engaged position. Further, the first latch 52 can be configured such that at least a portion of the engagement portion 54 is aligned with the attachment portion 53 along the transverse direction T both when the engagement portion 54 is in the engaged position and when the engagement portion 54 is in the disengaged position. It should be appreciated, of course, that the first latch 52 can be alternatively configured as desired.

The first latch 52 can further include at least one hinge 51 that extends from the first attachment portion 53 to the first engagement portion 54. For instance, the hinge 51 can extend from the rear end 56*b* of the attachment body 56 to the rear end 62*b* of the engagement body 62. Thus, it can be said that the hinge 51 extends from the attachment body 56 to the engagement body 62. The hinge 51 can define a flexible arm that extends from the first attachment portion 53 to the first engagement portion 54. At least a portion of the hinge 51 can be curved as it extends from the first attachment portion 53 to the first engagement portion 54. Thus, the hinge 51 can define a concavity that faces the forward direction. The engagement portion 54 can be configured to articulate about the at least one hinge 51 between the engaged position and the disengaged position. The at least one hinge 51 can include first and second hinges 51*a* and 51*b*, respectively, that are spaced from each other along the lateral direction A. Thus, a gap can extend between the first and second hinges 51*a* and 51*b* along the lateral direction A.

The at least one hinge 51 can support the engagement portion 54 at a position offset from the connector housing 22 along the transverse direction T when the attachment portion 53 is attached to the connector housing 22. Similarly, the at least one hinge 51 can support the engagement portion 54 at a position spaced from the attachment portion 53 along the transverse direction T. Further, the at least one hinge 51 can flex so as to allow the engagement portion 54 to selectively move between the engaged position and the disengaged position. Thus, the at least one hinge 51 can flex so as to allow the engagement portion 54 to selectively move toward and away from the connector housing 22. In one example, the engagement portion 54 moves toward the connector housing 22 as the engagement portion 54 moves to the disengaged position. The engagement portion 54 moves away from the connector housing 22 as the engagement portion 54 moves to the disengaged position.

The hinge 51 can thus support engagement portion 54 at a position that is both offset with respect to the attachment portion 53 along the transverse direction T, and at least partially aligned with the attachment portion 53 along the transverse direction T. Thus, it should be appreciated that as the engagement portion 54 moves away from the connector housing 22, the engagement portion 54 can similarly move away from the attachment portion 53. Similarly, as the engagement portion 54 moves toward the connector housing 22, the engagement portion 54 can similarly move toward the attachment portion 53.

The hinge 51 can be any suitably constructed hinge as desired. In one example, the hinge 51 can be a living hinge that extends from the attachment portion 53 to the engagement portion 54. Thus, the hinge 51 can be flexible to support movement of the engagement portion 54 toward and away from the engagement portion 54. In this regard, it should be appreciated that the hinge 51 can have a spring constant that resists movement of the engagement portion 54 toward the disengaged position. In one example, the attachment portion 53, and the engagement portion 54 can be monolithic with each other. In another example, the hinge 51 can be configured as a spring hinge that biases the engagement portion 54 toward the engaged position. Alternatively, one or more up to all of the hinge 51, the attachment portion 53, and the engagement portion 54 can be separate components that are secured to each other. For instance, the hinge 51 can define leaves that interdigitate and receive a hinge pin.

The movement of the engagement portion 54 about the hinge 51 can be a pivotal movement. In this regard, the hinge 51 can define a pivot axis, and the engagement portion 54 can pivot about the pivot axis between the engaged position and the disengaged position. The pivot axis can be oriented along the lateral direction A. The engagement portion 54 can pivot about the pivot axis between the engaged position and the disengaged position. Thus, the first engagement member 55 can be movable about the hinge 51 with respect to the first attachment portion 53 between the engaged position and the disengaged position. Selective movement of the first engagement member 55, and thus of the first engagement portion 54, toward each of the engaged position and the disengaged position about the pivot axis can be substantially perpendicular to the mating direction. That is, selective movement of the first engagement member 55 toward each of the engaged position and the disengaged position about the pivot axis can be substantially along the transverse direction T. In the engaged position, the first engagement member 55 is positioned to engage with the second engagement member of the second latch 102, thereby securing the first electrical connector 20 to the second electrical connector 100 when the electrical connectors are mated to each other. When the first engagement member 55 is in the disengaged position, the first latch 52 no longer engages the second latch 102, and thus no longer prevents the first electrical connector 20 from being unmated from the second electrical connector 100.

The latch 52 can be naturally biased to the engaged position. Thus, when the engagement portion 54 is moved toward the disengaged position, the engagement portion can be biased to return to the engaged position. For instance, the latch 52 can include a biasing member 71 that is configured to bias the first engagement portion 54 away from the first attachment portion 53. Thus, when the engagement portion 54 moves toward the first attachment portion 53, and thus also toward then connector housing 22, the biasing member 71 biases the engagement portion 54 and the attachment member 55 to return to the engaged position. In particular, the biasing member 71 can urge the first engagement portion 54, and thus the first engagement member 55, away from the first attachment portion 53. For instance, the biasing member 71 can urge the first engagement portion 54, and thus the first engagement member 55, to pivot about the pivot axis in a direction away from the first attachment portion 53. In particular, the biasing member 71 can contact the first engagement portion 54 so as to urge the first engagement portion 54, and thus the first engagement member 55, away from the first attachment portion 53. In one example, the electrical connector 20 does not include any biasing members external to the latch 52 that biases the latch 52 to the engaged position. In this regard, the biasing member 71 can be monolithic with the attachment portion 53 and the engagement portion 54.

The biasing member 71 can be configured in any suitable manner as desired. In one example, the biasing member 71 can be configured as a spring 72 that extends from the first attachment portion 53. For instance, the spring 72 can include one or more spring arms 73 that bear against the first engagement portion 54. The spring arms 74 can extend out from the first attachment portion 53 in one example. For instance, the spring arms 74 can be cantilevered from the first attachment portion 53. Thus, the spring 72 can be configured as a leaf spring. It should be appreciated that the biasing member 71 can be configured in any suitable alternative manner as desired so as to provide resistance to movement of the first engagement portion 54 toward the disengaged position. That is, the biasing member 71 can provide resistance to movement of the first engagement portion 54 toward the first attachment portion 53. In one example, the spring 72 can be a coil spring that extends from the first attachment portion 53 to the first engagement portion 54. Alternatively or additionally, the biasing member 71 can be defined by the hinge 51 as described above. For instance, the biasing member 71 can be configured as a torsion spring. In one example, the first latch 52 can define a single unitary monolithic structure. Thus, the first attachment portion 53, the first engagement portion 54, the at least one hinge 51, the biasing member 71, and the first engagement member 55 can combine to define a singular monolithic component. Alternatively one or more of the first attachment portion 53, the first engagement portion 54, the at least one hinge 51, the biasing member 71, and the first engagement member 55 can be separately attached to another of the first attachment portion 53, the first engagement portion 54, the at least one hinge 51, the biasing member 71, and the first engagement member 55 so as to define the first latch 52. In still another example, the spring 72 can extend out from the connector housing 22 so as to resist movement of the first engagement portion 54 toward the disengaged position. The first latch 52 can be made of any suitable material as desired. For instance, the latch 52 can be made out of a metal. Alternatively, the latch 52 can be made out of a plastic.

As described above, the first engagement member 55 can be configured to engage the second latch 102 so as to secure the first latch 52 to the second latch 102. The first engagement member 55 can include at least one projection 57 that extends out with respect to the first engagement portion 54 along the transverse direction T substantially away from the first attachment portion 53. The term "substantially away" recognizes that the first engagement portion 54 can be pivotally supported relative to the first attachment portion 53, and therefore the first engagement portion 54 may not be oriented parallel to the first attachment portion 53. Thus, the at least one projection 57 can extend up with respect to the first engagement portion 54.

The first engagement member 55 can include first and second projections 57. The first and second projections 57 can be spaced from each other along the lateral direction A. Thus, the first engagement portion 54 can define a gap that extends between the first and second projections 57 along the lateral direction A. Further, the projections 57 can be aligned with each other along the lateral direction A. Further still, the projections 57 can be constructed at least substantially identical to each other. In one example, the first and second projections 57 can be disposed equidistant from a central plane that bisects the engagement portion 54 into two equal halves with respect to the lateral direction A. The central plane can be defined by the longitudinal direction L and the transverse direction T.

In one example, the engagement portion 54, and thus the latch 52, can include a tongue 59 that extends out from the engagement body 62. The at least one projection 57 can extend out from the tongue 59. In particular, the projections 57 can extend out from the tongue 59 along the transverse direction T. For instance, the projections 57 can extend upward from the tongue 59. Because the at least one projection 57 is supported by the tongue 59, and the tongue 59 is supported by the engagement body 62, it can be said that the at least one projection 57 is supported by the engagement body 62. In another example, the at least one projection 57 can extend out directly from the engagement body 62.

In one example, the tongue 59 can extend out from the engagement body 62 in the forward direction to a front end 68. The front end 68 can be sloped in the downward direction as it extends in the forward direction. Thus, the tongue 59 can extend out from the engagement body 62 in the mating direction. For instance, the tongue 59 can extend out from the front end 62*a* of the engagement body 62 in the forward direction. Further, the tongue 59 can include a downwardly sloped wall 64 that extends down from the engagement body 62. For instance, the sloped wall 64 can extend down from the front end 62*a* of the engagement body 62 as it extends forward from the front end 62*a* of the engagement body 62. The sloped wall 64 can curve down as it curves in the forward direction so as to define an upward and forward facing concavity. Alternatively, the sloped wall 64 can be substantially planar as desired.

The tongue 59 can define a support wall 65 that extends forward from the sloped wall 64. The support wall 64 can be planar substantially along a plane that is defined by the lateral direction A and the longitudinal direction L. In one example, when the latch 52 is in the engaged position, the support wall 64 can be planar along the plane that is defined by the lateral direction A and the longitudinal direction L. When the latch 52 is in the disengaged position, the support wall 64 can be planar along a plane that is angularly offset with respect to the plane that is defined by the lateral direction and the longitudinal direction L. In particular, when the latch 52 in the disengaged position, the support wall can be planar along a plane that is defined by the lateral direction A, and a second direction that includes 1) a first directional component that is defined by the longitudinal direction L, and 2) a second directional component that is defined by the transverse direction T. It should be appreciated that the support wall 64 can extend parallel with the engagement body 62. Further, the support wall 64 can be disposed below the engagement body 62.

The tongue 59 can be centrally disposed with respect to the central plane. That is, the central plane can bisect the tongue 59 along the lateral direction A. Further, the central plane can bisect the attachment body 56 along the lateral direction A. Thus, it can be said that the central plane can bisect the first engagement member 55 along the lateral direction A. Further, the at least one projection can extend out from the tongue 59 at a positon spaced from the first engagement portion 54 in the mating direction. Further, the projections 57 can extend out from opposed sides of the tongue 59 that are opposite each other along the lateral direction A. For instance, the projections 57 can extend out from opposed sides of the support wall 64 that are opposite each other along the lateral direction A. Thus, the projections 57 can be disposed equidistantly from the central plane. It should be appreciated that the at least one projection 57 can extend out from any suitable alternative structure of the latch 52 as desired so as to be in engagement with the second latch 102 when the latch 52 is in the engaged position, and to be removed from engagement with the second latch 102 when the latch 52 is in the disengaged position.

Further, the at least one projections 57 can have a sloped front end 66 that can be configured to the first and second latches 52 and 102 to a position whereby the latches 52 and 102 are engaged with each other. The sloped front end 66 can extend down as it extends forward. Thus, as described in more detail below, the sloped front end 66 can define a cam surface that is configured to contact the second latch 102 so as to assist in engaging the first and second latches 52 and 102 to each other. Thus, the sloped front end 66 can be said to define a lead-in surface of the at least one projection 57. The front edge of the front end 66 can be at least substantially coplanar with the rear edge of the sloped front wall 68 along a plane defined by the lateral direction A and the longitudinal direction L.

Referring now to FIGS. 3A-3C in particular, and as described above, the first latch 52 is movable between the engaged position and the disengaged position. For instance, the first latch 52 can be moved from the engaged position to the disengaged position. Further, the first latch 52 can be moved from the disengaged position to the engaged position. Further, the normal position of the first latch 52 is the engaged position. That is, the latch 52 can be in the engaged position absent an external force that causes the latch 52 to move to the disengaged position. An entirety of the latch 52 can be disposed entirely between the rear end of the electrical connector 20 and the front end of the electrical connector 20 with respect to the mating direction. Thus, the latch 52 can be constructed so as to not add to the overall footprint of the electrical connector.

The first latch 52 can further include a first at least one stop member 58 that extends from the first attachment portion 53, and a second at least one stop member 60 that extends from the first engagement portion 54. The first and second stop members 58 and 60 are not defined by the connector housing in one example. The first and second stop members 58 and 60 can be configured to contact each other when the latch 52 is in the engaged position. In particular, the biasing member 71 can apply a biasing force to the first engagement portion 54 that causes the first engagement to move from the disengagement position to the engagement direction, which causes the stop members 58 and 60 to contact each other. The biasing force can further maintain the stop members 58 and 60 in contact with each other. Thus, the biasing force can be said to maintain the first latch 52 in the engaged position. When the stop members 58 and 60 contact each other, they can prevent further movement of the first engagement portion 54 in the engagement direction. The first and second stop members 58 and 60 can be in direct contact with each other, or in contact with each other via one or more intermediate structures.

It should be appreciated that the at least one stop member 58 that extends from the first attachment portion 53 can include first and second stop members 58. The first and second stop members 58 can be spaced from each other along the lateral direction A. Further, the first and second stop members 58 can be aligned with each other along the lateral direction A. The first and second stop members 58 can be spaced equidistantly from the central plane along the lateral direction A. Thus, it can be said that the at least one stop member 58 is centrally disposed with respect to the central plane along the lateral direction A. The at least one stop member 60 that extends from the first engagement portion 54 can include first and second stop members 60. The first and second stop members 60 can be spaced from each other along the lateral direction A. Further, the first and second stop members 60 can be aligned with each other along the lateral direction A. The first second stop members 60 can be spaced equidistantly from the central plane along the lateral direction A. Thus, it can be said that the at least one stop member 60 is centrally disposed with respect to the central plane along the lateral direction A.

One of the first and second stop members 58 and 60 can wrap around the other of the first and second stop members 58 and 60 so as to contact the other of the first and second stop members 58 and 60 when the first latch 52 is in the engaged position. In one example, the one of the first and second stop members can extend forward of the other of the first and second stop members 58 and 60 from a location offset from the other of the first and second stop members 58 and 60 in a first direction along the transverse direction T, and can wrap around the other of the first and second stop members 58 and 60 in a plane that is defined by the longitudinal direction L and the transverse direction T to a position that is 1) adjacent the other of the first and second stop members 58 and 60 in a second direction along the transverse direction T that is opposite the first direction, and 2) in contact with the other of the first and second stop members 58 and 60, thereby maintaining the latch 52 in the engaged position.

For instance, the other of the stop members 58 and 60 can extend in the mating direction from a first corresponding one of the first attachment portion 53 and the first engagement portion 54 from which the other of the stop members 58 and 60 extends. Thus, the other of the stop members 58 and 60 can extend in the mating direction to a distal end 81 that is offset from the first corresponding one of the first attachment portion 53 and the first engagement portion 54 in the mating direction.

The one of the stop members 58 and 60 can include a proximal portion 80 that extends in the mating direction from a second corresponding one of the first attachment portion 53 and the first engagement portion 54 from which the first of the stop members 58 and 60 extends. The first of the stop members 58 and 60 further includes a bent region 82, and a distal portion 84 that extends from the bent region 82 in the unmating direction. Thus, the bent region can extend from the proximal portion 80 to the distal portion 84. The bent region 82 can define a concavity that faces the rearward direction. The distal portion 84 can define a free terminal end of the one of the first and second stop members 58 and 60. The bent region 82 supports the distal portion 84 at a position such that at least a portion of the distal portion 84 is aligned with the proximal portion 80 along the transverse direction T. Thus, a gap is disposed between the proximal portion and the distal portion 84 along the transverse direction T. The gap is configured to receive the other of the first and second stop members 58 and 60 both when the latch 52 is in the engaged position and when the latch 52 is in the disengaged position.

The distal portion 84 can be configured to contact the other of the stop members 58 and 60. For instance, the other of the first and second stop members 58 and 60 can contact the distal portion 84 when the latch 52 is in the engaged position. In one example, the other of the stop members 58 and 60 can contact the inner surface 86 of the distal portion 84. The proximal portion 80 can also be configured to contact the other of the stop members 58 and 60. For instance, the other of the first and second stop members 58 and 60 can contact the proximal portion 80 when the latch 52 is in the disengaged position. For instance, the proximal portion 80 can define an inner surface 83 that faces the distal portion 84, and an outer surface 85 opposite the inner surface 83. The outer surface 85 can be opposite the inner surface 83 substantially along the transverse direction T. The gap can extend from the inner surface 83 of the proximal portion 80 to the inner surface 86 of the distal portion 84 along the transverse direction T. The other of the stop members 58 and 60 can contact the inner surface 83 of the proximal portion 80 when the latch 52 is in the disengaged position. Thus, movement of the latch 52 between the engaged position and the disengaged position is bound by selective contact between the other of the stop members 58 and 60 and the inner surfaces 83 and 86.

In particular, the other of the stop members 58 and 60 can extend into the gap. For instance, the distal end 81 of the other of the stop members 58 and 60 can extend into the gap. The other of the stop members 58 and 60 can travel in the gap as the latch 52 moves between the engaged position and the disengaged position. Thus, the latch 52 can be moved in the engagement direction until the other of the stop members 58 and 60 contacts the distal portion 84. When the other of the stop members 58 and 60 contacts the distal portion 84, interference between the distal portion and the other of the stop members 58 and 60 prevents the latch 52 from moving further in the engagement direction. The latch 52 can be moved in the disengagement direction until the other of the stop members 58 and 60 contacts the proximal portion 80. Alternatively or additionally, the other of the stop members 58 and 60 can contact the bent region 82 when the latch is in the disengaged position. When the other of the stop members 58 and 60 contacts one or both of the proximal portion 80 and the bent region 82, interference between the proximal portion and the other of the stop members 58 and 60 prevents the latch 52 from moving further in the disengagement direction. The biasing member 71 can bias the latch 52 to the engaged position, as described above.

In one example, the one of the first and second stop members 58 and 60 can be defined by the second stop member 60 that extends from the first engagement portion 54. Thus, the other of the first and second stop members 58 and 60 can be defined by the first stop member 58 that extends from the first attachment portion 53. Accordingly, the distal portion 84 is spaced below the proximal portion 80. Alternatively, the one of the first and second stop members 58 and 60 can be defined by the first stop member 58 that extends from the first attachment portion 53. Thus, the other of the first and second stop members 58 and 60 can be defined by the second stop member 60 that extends from the first engagement portion 54. Accordingly, the distal portion 84 can be spaced above the proximal portion 80.

During operation, the first engagement portion 54 can move between the engaged position and the disengaged position. Accordingly, the first engagement member 55 can similarly move between the engaged position and the disengaged position. For instance, the first engagement member 55 can move in the upward direction as the latch 52 moves from the disengaged position to the engaged position. Thus, the at least one projection 57 can move in the upward direction as the latch 52 moves from the disengaged position to the engaged position. Alternatively, the latch 52 can be configured such that the first engagement member 55 can move in the downward direction as the latch 52 moves from the disengaged position to the engaged position. Thus, the at least one projection 57 can move in the downward direction as the latch 52 moves from the disengaged position to the engaged position. In one example, the at least one projection 57 can be disposed forward with respect to the one of the first and second stop members 58 and 60. For instance, the at least one projection 57 can be disposed forward with respect to the second stop member 60. Further, the at least one projection 57 can be disposed forward with respect to each of the first and second stop members 58 and 60. In this regard, it should be appreciated that the tongue 59 can extend to a location forward of the one of the first and second stop members 58 and 60. For instance, the tongue 59 can be disposed forward with respect to the second stop member 60. Further, the tongue 59 can be disposed forward with respect to each of the first and second stop members 58 and 60.

The first latch 52 can define a textured surface 69 at the upper surface of the engagement body 62. Thus, it can be said that upper surface of the engagement portion 54 can be textured. The textured surface 69 can assist with moving the latch from the engaged position to the disengaged position, as will be described in more detail below. In one example, the textured surface 69 can be defined by one or more ribs 70 that are formed in the engagement body 62, and thus in the engagement portion 54. The ribs 70 can be embossed in the engagement body 62 as desired so as to project upward with respect to the engagement body 62. The engagement portion 54 can include any number of ribs 70 as desired. In one example, the ribs 70 can be oriented along the lateral direction, and can be spaced from each other along the longitudinal direction L. Thus, the ribs 70 can be configured to receive force that is applied to the engagement body 62 in the downward direction and in the forward direction that both moves the latch 52 to the disengagement position and moves the first electrical connector 20 in the mating direction.

Figure 5B:
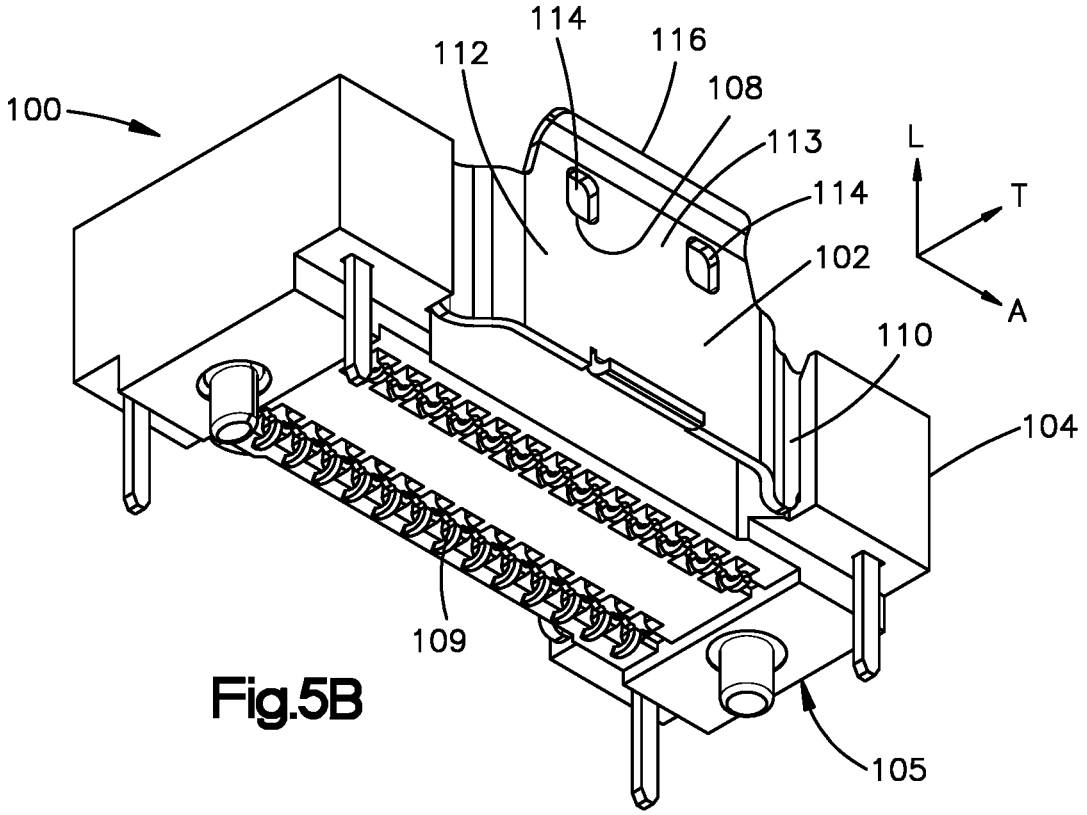
FIG. 5B is another perspective view of the second electrical connector illustrated in FIG. 4.

Referring now to FIGS. 4-5B an electrical connector system 98 can include the first electrical connector 20 and the second electrical connector 100. The second electrical connector 100 includes an electrically insulative second housing 104, and a plurality of second electrical contacts 106 supported by the second housing 104. The plurality of second electrical contacts 106 define mating ends 107 and mounting ends 109 opposite the mating ends 107. The mating ends 25 of the first electrical contacts 24 are configured to mate with the mating ends 107 of the second electrical contacts 106 when the first electrical connector 20 is mated with the second electrical connector 100.

In one example, the second electrical contacts 106 can be configured as vertical contacts whereby the mating ends 107 and the mounting ends 109 are inline with each other. For instance, the mating ends 107 and the mounting ends 109 can be disposed opposite each other with respect to a longitudinal direction L. Thus, the second electrical connector 100 can be referred to as a vertical electrical connector. Alternatively, the second electrical contacts 106 can be configured as right-angle contacts whereby the mating ends 107 and the mounting ends 109 are oriented substantially perpendicular to each other. When the second electrical contacts 106 are configured as right-angle contacts, the second electrical connector 100 can be referred to as a right-angle electrical connector.

The second electrical connector 100 can define a second mating interface 103. The second mating interface 103 can be disposed at a front end of the second electrical connector 100. The mating ends 107 of the second electrical contacts 106 can be disposed at the second mating interface 103. For instance, the mating ends 107 can be disposed at opposed sides of the mating interface 103 that are opposite each other along the transverse direction T. In one example, the second mating interface 103 can be configured as a receptacle 115 that is configured to be receive the plug 39 that is defined by the first mating interface 31 of the first electrical connector 20 (see FIG. 1A) so as to mate the electrical connectors 20 and 100 to each other. Thus, the mating ends 107 can be disposed at opposite sides of the receptacle. Alternatively, the second mating interface 103 can be configured as a plug that is configured to be receive the second mating interface 103 so as to mate the electrical connectors 20 and 100 to each other.

The second electrical connector 100 defines a second mounting interface 105. The mounting ends 109 of the second electrical contacts 106 can be disposed at the second mounting interface 105. The second electrical connector 100 can be mounted to a complementary electrical component at the mounting interface 105. The complementary electrical component can be configured as a substrate 111. The substrate 111 can be configured as a printed circuit board as desired. The second electrical contacts 106 are configured to be mounted to the substrate 111 at the respective second mounting ends 109. Thus, when the second electrical connector 100 is configured as a vertical electrical connector, the second mounting interface 105 can be oriented parallel with the second mating interface 103. Further, the second mounting interface 105 can be opposite the second mating interface 103 along the longitudinal direction L. Thus, the second mounting interface 105 can be defined at a rear end of the electrical connector. Alternatively, when the second electrical connector 100 is configured as a right angle electrical connector, the second mounting interface 105 can be disposed at a bottom of the second electrical connector 100. It should be appreciated that the second electrical connector 100 can be mounted to any suitable complementary electrical component as desired. For instance, the complementary electrical component can alternatively be configured as electrical cables as described above with respect to the first electrical connector 20.

Reference to a "forward direction" or "front" with respect to the complementary electrical connector 100 and components thereof can be interpreted with respect to the complementary mating direction from the rear end to the front end. Conversely, reference to a "rearward direction" or "rear" with respect to the complementary electrical connector 100 and components thereof can be interpreted with respect to the unmating direction from the front end to the rear end. Thus, the forward direction with respect to the second electrical connector 100 can be opposite the forward direction with respect to the first electrical connector 20. Further, the rearward direction with respect to the second electrical connector 100 can be opposite the rearward direction with respect to the first electrical connector 20.

The second electrical connector 100 is configured to mate with the first electrical connector 20 in a respective mating direction toward the first electrical connector 20. Thus, the mating direction of the second electrical connector 100 is opposite the mating direction of the first electrical connector 20. Similarly, the second electrical connector 100 can be configured to unmate from the first electrical connector 20 by moving the second electrical connector 100 in a respective unmating direction with respect to the first electrical connector 20. The respective unmating direction can be opposite the respective mating direction. Thus, the respective unmating direction can be opposite the unmating direction of the first electrical connector 20. Further, both the respective mating direction and the respective unmating direction of the second electrical connector 100 can be oriented along the longitudinal direction L.

As described above, the second electrical contacts 106 are configured to be placed in contact, and thus electrical communication, with the first electrical contacts 24 when the first and second electrical connectors 20 and 100 are mated to each other. The second electrical contacts 106 can be arranged along respective columns that are spaced from each other along the transverse direction T. The electrical contacts 106 of each column can be spaced from each other along the lateral direction A. Thus, the mating ends 107 of a first one of the columns of second electrical contacts 106 can be disposed at a first side of the second mating interface 103, and the mating ends 107 of a second one of the columns of the second electrical contacts 106 can be disposed at a second side of the mating interface 103 that is opposite the first side along the transverse direction T. The mating ends 107 of the electrical contacts 106 of each column can be spaced from each other and aligned with each other along the lateral direction A.

The second electrical contacts 106 can include signal contacts and ground contacts as described above with respect to the first electrical connector 20. Thus, the signal and ground contacts can be aligned with each other along the respective column. That is, the signal and ground contacts of the second electrical contacts 106 of a respective column can be aligned with each other along the lateral direction A. The signal and ground contacts can be arranged in any pattern along the column as desired, as described above with respect to the first electrical connector 20. Thus, the signal contacts 26 of the first electrical contacts 24 can mate with signal contacts of the second electrical contacts 106 when the first and second electrical connectors 20 and 100 are mated with each other. Further, the ground contacts 28 of the first electrical contacts 24 can mate with the ground contacts of the second electrical contacts 106 when the first and second electrical connectors 20 and 100 are mated with each other. As described above with respect to the first electrical connector 20, immediately adjacent ones of the signal contacts along the columns can be configured as differential signal pairs. Alternatively, the signal contacts can be single ended.

With continuing reference to FIGS. 5A-5B, and as described above, the second electrical connector 100 can include the second latch 102 that is supported by the second connector housing 104. The description of the second latch 102 below includes reference to the first latch 52, and reference is made to FIGS. 3A-3C for that purpose. The second latch 102 can include a second engagement member 108 that is configured to engage to the first engagement member 55 of the first latch so as to secure the first and second latches 52 and 102 to each other when the first engagement member is in the engaged position and the first and second electrical connectors 20 and 100 are mated to each other. When the latches 52 and 102 are secured to each other while the first and second electrical connectors 20 and 100 are mated with each other, the latches 52 and 102 resist separation of the first and second connectors 20 and 100 from each other. Thus, when the latches 52 and 102 are secured to each other while the first and second electrical connectors 20 and 100 are mated with each other, the latches 52 and 102 can prevent the first and second electrical connectors 20 and 100 from being unmated from each other.

As will be appreciated from the description below, the first and second latches 52 and 102 can be releasably secured to each other. For instance, the first latch 52 can be movable between the engaged position and the disengaged position as described above with respect to FIGS. 3A-3C. When the first latch 52 is in the engaged position, the first and second latches 52 and 102 can be secured to each other. When the first latch 52 is in the disengaged position, the first and second latches 52 and 102 can be removed from each other. Thus, the first and second electrical connectors 20 and 100 can be unmated from each other.

The second latch 102 can include a second attachment portion 110 that is attached to the second housing 104, and a second engagement portion 112 that is supported by the second attachment portion. The first and second engagement portions 54 and 112 are configured to engage each other when the first latch 52 is in the engaged position, thereby securing the first and second latches 52 and 102 to each other. The first latch 52 can be moved to the disengaged position so as to remove the first latch 52 from the second latch 102. The second engagement member 108 is supported by the second engagement portion 112. The second engagement portion 112 can define a second engagement body 113. The second engagement body 113 can be configured as a plate. In one example, the second engagement body 113 can be substantially planar along a plane. The plane can be at least substantially defined by the lateral direction A and the longitudinal direction L. The second engagement member 108 can be configured as at least one aperture 114 that extends through the second engagement body 113. In one example, the second engagement member 108 can be configured as at least one aperture 114 that extends through the second engagement portion 112 along the transverse direction T. The at least one aperture 114 can be sized to receive the at least one projection 57 of the first latch 52.

The at least one aperture 114 can include first and second apertures 114. The first and second apertures 114 can be spaced from each other along the lateral direction A Further, the first and second apertures 114 can be aligned with each other along the lateral direction A. Further, the first and second apertures 114 can be disposed equidistant from a respective central plane that bisects the second engagement portion 112 into two equal halves with respect to the lateral direction A. Thus, the respective central plane can be defined by the longitudinal direction L and the transverse direction A. Each of the at least one aperture 114 can receive a respective one of the at least one projection 57 of the first latch 52 in order to releasably secure the first and second latches 52 and 102 to each other when the first latch 52 is in the engaged position.

The complementary latch 102 can define a sloped front end 116 that is configured to ride along the sloped front end 66 of the first latch 52 as the first and complementary electrical connectors 20 and 100 are mated to each other. The sloped front ends 66 and 116 can guide the latches 52 into engagement with each other as the electrical connectors 20 and 100 are mated. For instance, the sloped front end 66 can ride along the sloped front end 116 as the first and second electrical connectors 20 and 100 are mated with each other, and can subsequently slide along the second engagement body 113 until the at least one projection 57 is inserted into the at least one aperture 114 as illustrated in FIG. 4.

During operation, the first and second electrical connectors 20 and 100 can be aligned with each other along the longitudinal direction L. Next, the plug 39 of one of the first and second electrical connectors can be received in the receptacle 115 of the other of the first and second electrical connectors as one or both of the first and second electrical connectors is moved along a respective mating direction toward the other of the first and second electrical connectors. As the plug 39 is received in the receptacle 115, the sloped front end 116 of the second latch 102 is aligned with a sloped front end of the first latch 52. The sloped front end of the first latch 52 can be defined by one or both of the sloped front end 66 of the at least one projection 57 and the sloped front end 68 of the tongue 59.

Alternatively, the disengagement force can be applied to the first latch 52 to move the first latch 52 to the disengaged position prior to mating the first and second electrical connectors 20 and 100 to each other. The disengagement force can be removed once the electrical connectors 20 and 100 have been mated, which causes the at least one projection 57 to be inserted into the at least one aperture 114. The disengagement force can be applied to the first latch 52 by gripping the textured upper surface of the first engagement portion 54. The mating force can also be applied to the first electrical connector 20 while gripping the textured upper surface of the first engagement portion 54.

In particular as the sloped front end of the first latch 52 contacts the sloped front end 116 of the second latch 102, the sloped front end 116 rides along the sloped front end 116, which causes the first engagement portion 54 to move toward the disengaged position. In the disengaged position, the at least one projection 57 is displaced to a location whereby it is not configured to be inserted into the at least one aperture 114. Movement of the latch 52 from the engaged position to the disengaged position is against the force applied by the biasing member 71. Thus, the latch 52 is biased to naturally return to the engaged position. Accordingly, as the latches 52 and 102 are engaged with each other during mating of the electrical connectors 20 and 100, the at least one projection 57 rides along the second engagement body 113 until it is aligned with the at least one aperture 114. In particular, the at least one projection 57 can ride along a lower surface of the second engagement body 113. Once the at least one projection 57 is aligned with the at least one aperture 114, the force of the biasing member 71 causes the at least one projection 57 to be inserted into the at least one aperture 114, thereby securing the first latch 52 to the second latch 102.

The first and second latches 52 and 102 can be disengaged from each other so as to allow the first and second electrical connectors 20 and 100 to be unmated from each other. In particular, a disengagement force can be applied to the engagement portion 54 of the first latch 52 in the disengagement direction. For instance, the disengagement force can be a downward force. The disengagement force can be applied to the upper surface of the engagement portion 54. In one example, a user can apply a disengagement force with his or her thumb or other digit to a gripping surface that is defined by the ribs #. Once the at least one projection 57 has been removed from the at least one aperture 114, the first and second electrical connectors 20 and 100 can be unmated from each other.

It should be appreciated that methods of mating the first and complementary electrical connectors 20 and 100 are disclosed herein. The methods can include the step of placing the first electrical contacts 24 in contact with the complementary electrical contacts 106, wherein the placing step causes the first engagement member 55 to releasably secure to the complementary engagement member 108. Further, as described above, the placing step includes the step of moving one or both of the first and complementary electrical connectors 20 and 100 in the respective mating direction with respect to the other electrical connector.

Further, it should be appreciated that methods of unmating the first and complementary electrical connectors 20 and 100 from each other are disclosed herein. The methods can include the step of applying the disengagement force to the first engagement portion 54 toward the first attachment portion 53 that is sufficient to cause the first engagement member 55 to move toward the first attachment portion 53 a sufficient distance so as to separate the first engagement member 55 from the complementary engagement member 108. In particular, the at least one projection 57 is removed from the at least one aperture 114. Next, one or both of the first and complementary electrical connectors can be moved away from each other in the respective unmating direction.

It should be appreciated that the illustrations and discussions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should be further appreciated that the various alternative embodiments described above with respect to one illustrated embodiment can apply to all embodiments as described herein, unless otherwise indicated.

What is claimed:

1. An electrical connector comprising:

an electrically insulative connector housing, and a plurality of electrical contacts supported by the electrically insulative connector housing, wherein the electrical connector defines a mating interface that is configured to engage a second mating interface of a second electrical connector so as to mate the electrical connector with the second electrical connector along a mating direction; and a latch supported by the connector housing, the latch configured to secure the electrical connector to the second electrical connector when the electrical connector is mated to the second electrical connector, the latch comprising:

an attachment portion and a first stop member that extends from the attachment portion;

an engagement portion configured to engage a second latch of the second electrical connector, an engagement member supported by the engagement portion, and a second stop member that extends from the engagement portion;

a hinge that extends from the attachment portion to the engagement portion, wherein the engagement member is movable about the hinge with respect to the attachment portion between an engaged position and a disengaged position, a biasing member that is configured to apply a biasing force to the engagement portion that biases the engagement portion to move in an engagement direction toward the engaged position, wherein the biasing member is configured to apply the biasing force to the engagement portion that biases the engagement portion to move in an engagement direction toward the engaged position until the first and second stop members contact each other, thereby preventing further movement of the first engagement member in the engagement direction, and wherein one of the first and second stop members wraps around the other of the first and second stop members so as to contact the other of the first and second stop members when the latch is in the engaged position.

2. The electrical connector as recited in claim 1, wherein the engagement portion is spaced from the attachment portion in an upward direction, and the engagement member comprises at least one projection that extends out with respect to the engagement portion in the upward direction.

3. The electrical connector as recited in claim 2, wherein the at least one projection comprises first and second projections that are aligned with each other along a lateral direction that is perpendicular to a transverse direction that includes the upward direction.

4. The electrical connector as recited in claim 1, wherein movement of the engagement member about the hinge in the engagement direction is away from the attachment portion, and movement of the engagement member about the hinge in a disengagement direction from the engaged position toward the disengaged position is substantially toward the attachment portion.

5. The electrical connector as recited in claim 1, wherein the attachment portion, the engagement portion, the hinge, and the biasing member combine so as to define a singular monolithic component.

6. The electrical connector as recited in claim 1, wherein the biasing member comprises a spring that extends from the attachment portion.

7. The electrical connector as recited in claim 6, wherein the biasing member is at least partially defined by the hinge.

8. The electrical connector as recited in claim 1, wherein the engagement portion comprises an engagement body, and a tongue that extends out from the engagement body in the mating direction, and wherein the engagement member extends out from the tongue.

9. The electrical connector as recited in claim 8, wherein the attachment portion is spaced from the engagement portion along a downward direction, and the tongue comprises a downwardly sloped wall that extends down from as it extends from the engagement body in the mating direction.

10. The electrical connector as recited in claim 8, wherein at least one projection extends out from the tongue.

11. The electrical connector as recited in claim 1, wherein:

the engagement portion and the attachment portion are spaced from each other along a transverse direction, and one of the first and second stop members extends forward of the other of the first and second stop members in the mating direction from a location offset from the other of the first and second stop members in a first direction along the transverse direction T, and wraps around the other of the first and second stop members to a position that is 1) adjacent the other of the first and second stop members in a second direction along the transverse direction T that is opposite the first direction, and 2) in contact with the other of the first and second stop members, thereby maintaining the latch in the engaged position.

12. The electrical connector as recited in claim 11, wherein the other of the first and second stop members extends in the mating direction to a distal end.

13. The electrical connector as recited in claim 12, wherein the one of the stop members comprises a proximal portion that extends in the mating direction, a bent region, and a distal portion that extends from the bent region in an unmating direction.

14. The electrical connector as recited in claim 13, wherein the bent region defines a concavity that faces the unmating direction that is opposite the mating direction.

15. The electrical connector as recited in claim 13, wherein the distal portion defines a free terminal end of the one of the first and second stop members.

16. The electrical connector as recited in claim 13, wherein the bent region supports the distal portion so as to define a gap that is disposed between the proximal portion and the distal portion along the transverse direction.

17. The electrical connector as recited in claim 16, wherein the other of the first and second stop members extends into the gap both when the latch is in the engaged position and when the latch is in the disengaged position.

18. The electrical connector as recited in claim 13, wherein the other of the first and second stop members contacts the distal portion when the latch is in the engaged position.

19. The electrical connector as recited in claim 1, wherein the attachment portion is attached to the connector housing.

20. The electrical connector as recited in claim 19, wherein the attachment portion is insert molded in the connector housing.

21. The electrical connector as recited in claim 1, wherein the electrical connector defines a rear end that is opposite the mating interface, and the latch is disposed entirely between the rear end and the mating interface with respect to the mating direction.

22. The electrical connector as recited in claim 1, wherein the electrical contacts include first and second signal contacts that are immediately adjacent each other along a lateral direction, and a first ground contact that is immediately adjacent the first signal contact, such that the first signal contact is disposed between the first ground contact and the second signal contact;

wherein the first signal contact defines a first signal projection that extends toward the first ground contact along the lateral direction, and terminates without touching the first ground contact.

23. The electrical connector as recited in claim 22, wherein the first signal contact defines first and second edges spaced from each other along the lateral direction, and first and second broadsides that are spaced from each other along a transverse direction that is substantially perpendicular to the lateral direction, and wherein the one of the edges that faces the first ground contact defines the projection.

24. The electrical connector as recited in claim 23, wherein the broadsides are coplanar with the first signal projection.

25. The electrical connector as recited in claim 22, wherein the first ground contact defines a first ground projection that extends toward the first signal contact along the lateral direction, and terminates without touching the first signal contact.

26. The electrical connector as recited in claim 25, wherein the first ground projection is aligned with the first signal projection along the lateral direction.

27. A system comprising electrical connector of claim 1 and the second electrical connector of claim 1, wherein the latch is configured to releasably engage a second latch of the second electrical connector when the electrical connector and the second electrical connectors are mated to each other.

28. The system as recited in claim 27, wherein the second latch defines at least one aperture that receives the engagement member when the latch of the electrical connector is in the engaged position.

29. The system as recited in claim 28, wherein the latch of the electrical connector is configured to receive a disengagement force that urges the engagement member out of the aperture so as to permit the electrical connector and the second electrical connector to be unmated from each other.

* * * * *